United States Patent [19]

Parks

[11] Patent Number: 4,987,944

[45] Date of Patent: Jan. 29, 1991

[54] METHOD OF MAKING A TURBINE ENGINE COMPONENT

[75] Inventor: Paul L. Parks, Minerva, Ohio

[73] Assignee: PCC Airfoils, Inc., Cleveland, Ohio

[21] Appl. No.: 436,188

[22] Filed: Nov. 13, 1989

[51] Int. Cl.[5] ..... B22C 9/04; B22C 9/20

[52] U.S. Cl. ..... 164/10; 164/35; 164/108; 164/112; 29/889.21

[58] Field of Search ..... 164/9, 10, 11, 35, 34, 164/36, 137, 98, 112, 108; 29/156.86, 156.8 R, 889.21, 889

[56] References Cited

U.S. PATENT DOCUMENTS

| | | | |
|---|---|---|---|
| 1,005,736 | 10/1911 | Wilkinson | 164/11 |
| 2,097,314 | 10/1937 | Wales | 164/11 |
| 2,143,464 | 1/1939 | Allard | 164/11 |
| 3,279,006 | 10/1966 | Schwartz et al. | 164/65 |
| 3,596,703 | 8/1971 | Bishop | 164/132 |
| 3,669,177 | 6/1972 | Ingalls et al. | 164/516 |
| 3,848,654 | 11/1974 | Boyle et al. | 164/34 |
| 3,957,104 | 5/1976 | Terpay | 164/132 |
| 4,008,052 | 2/1977 | Vishnevsky et al. | 428/612 |
| 4,195,683 | 4/1980 | Blazek | 164/10 |
| 4,556,528 | 12/1985 | Gersch et al. | 294/61 |
| 4,728,258 | 3/1988 | Blazek et al. . | |
| 4,737,417 | 4/1988 | Mushardt et al. | 29/156.8 R |
| 4,874,031 | 10/1989 | Janney | 164/137 |

*Primary Examiner*—Richard K. Seidel
*Assistant Examiner*—Rex E. Pelto
*Attorney, Agent, or Firm*—Tarolli, Sundheim & Covell

[57] ABSTRACT

A turbine engine component having an annular array of airfoils disposed between inner and outer shroud rings is made by a method which includes molding bodies of positioning material around central portions of the airfoils. The bodies of positioning material are placed in an annular array. Inner and outer shroud ring pattern dies cooperate with the bodies of positioning material to form inner and outer shroud ring pattern mold cavities. Pattern material is injected into the inner and outer shroud ring pattern mold cavities. The pattern material engages the airfoils, the positioning material, and the shroud ring pattern dies. The pattern material is solidified to form one piece annular inner and outer shroud ring patterns. The shroud ring patterns are covered with a ceramic mold material to form a mold. The inner and outer shroud ring patterns are then removed from the mold to leave shroud ring mold cavities. Different spatial relationships can be obtained between airfoils in one turbine engine component and the airfoils in another turbine engine component by changing the relationship of the airfoils to the bodies of positioning material.

74 Claims, 8 Drawing Sheets

METHOD OF MAKING A TURBINE ENGINE COMPONENT

BACKGROUND OF THE INVENTION

The present invention relates to a method of making a turbine engine component having airfoils connected with a shroud ring. More specifically, the present invention relates to the manner in which the shroud ring is formed.

A known turbine engine component is disclosed in U.S. Pat. No. 4,728,258 issued Mar. 1, 1988 and entitled "Turbine Engine Component and Method of Making the Same". This patent discloses making a turbine engine component having an annular array of airfoils disposed between inner and outer shroud rings. In order to minimize thermal stresses during use of the turbine engine component, slip joints are provided between the airfoils and a shroud ring to accommodate thermal expansion of the airfoils relative to the shroud rings.

In making the turbine engine component disclosed in U.S. Pat. No. 4,728,258, airfoils are placed in an annular array with end portions of the airfoils embedded in wax inner and outer shroud ring patterns. The wax shroud ring patterns are covered with ceramic mold material to form a mold. The inner and outer shroud ring patterns are then removed to leave inner and outer shroud ring mold cavities in which inner and outer end portions of the airfoils are disposed.

In order to form the inner and outer shroud ring patterns, one or more airfoils is held in a clamp which accurately positions inner and outer end portions of an airfoil in die cavities. The die cavities have a configuration corresponding to the configuration of segments of the inner and outer shroud rings. Hot wax is injected into the die cavities. The hot wax solidifies to form segments of the inner and outer shroud ring patterns. The airfoils are then placed in an annular array with the shroud ring patterns in abutting engagement. The shroud ring pattern segments are then interconnected with a suitable adhesive or hot wax to form annular inner and outer shroud ring patterns.

Relatively expensive fixtures or tooling is used to grip the airfoils and to position them relative to the die cavities in which pattern wax is molded. If it is desired to change the spatial relationship between the airfoils, relatively expensive fixtures and dies must be fabricated. Thus, there is a substantial initial investment in tooling to accurately position the airfoils and in dies to form cavities in which the shroud ring pattern segments are to be formed. If it is desired to make even a relatively small change in the spatial relationship between the airfoils, for example to change the angle of the airfoils by a small amount, new fixtures and dies must be fabricated.

SUMMARY OF THE PRESENT INVENTION

The present invention provides a method of making turbine engine components wherein the spatial relationship between airfoils and shroud rings can be changed without replacing expensive fixtures and/or dies which were previously used during forming of the shroud ring patterns. This is accomplished by molding bodies of a positioning or first material around the airfoils. The bodies of positioning material are utilized to locate the airfoils relative to each other during positioning of the airfoils in an annular array.

After the airfoils have been positioned in an annular array, dies cooperate with the positioning material to form an annular shroud ring pattern mold cavity. The annular shroud ring pattern mold cavity is filled with pattern material which engages the bodies of positioning material and end portions of the airfoils. The pattern material is solidified to form a shroud ring pattern. The positioning bodies are then removed from between the airfoils.

The shroud ring pattern is covered with mold material to form a mold. The shroud ring pattern is removed from the mold to leave an annular shroud ring mold cavity. Molten metal is conducted into the annular shroud ring mold cavity to form a shroud ring.

BRIEF DESCRIPTION OF THE DRAWINGS

The foregoing and other features of the present invention will become more apparent upon a consideration of the following description taken in connection with the accompanying drawings wherein.

DESCRIPTION OF SPECIFIC PREFERRED EMBODIMENTS OF THE INVENTION

General Description

Figure 1:
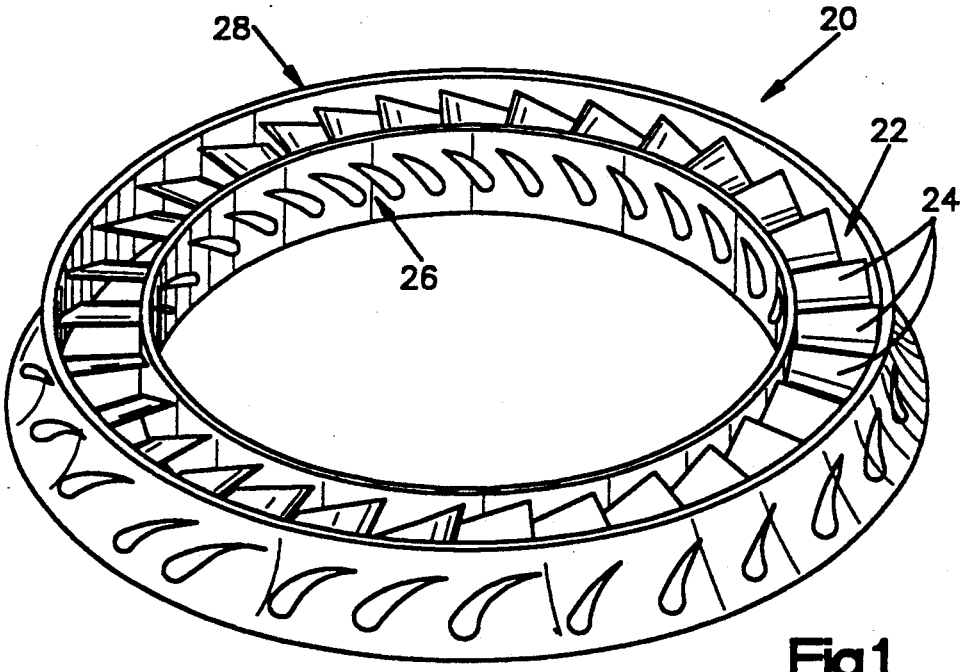
FIG. 1 is a pictorial illustration of a turbine engine component formed with the method of the present invention.

A turbine engine component 20 constructed in accordance with the present invention is illustrated in FIG. 1. In the present instance the turbine engine component 20 is a stator which will be fixedly mounted between the combustion chamber and first stage rotor of a turbine engine. The hot gases from the combustion chamber are directed against an annular array 22 of airfoils or vanes 24 which extend between a circular inner shroud ring 26 and a circular outer shroud ring 28. Although it is believed that the turbine engine component 20 will be particularly advantageous when used between the combustion chambers and first stage rotor of a turbine engine, it should be understood that turbine engine components constructed in accordance with the present invention can be used in other locations in an engine. Rather than being a stator, the turbine engine component could be a rotor. If desired, one of the shroud rings 26 or 28 could be omitted.

The airfoils 24 are formed separately from the inner and outer shroud rings 26 and 28. This allows the airfoils 24 to be formed of metal and/or ceramic material which can withstand the extremely high operating temperatures to which they are exposed in the turbine engine. Since the shroud rings 26 and 28 are subjected to operating conditions which differ somewhat from the operating conditions to which the airfoils 24 are subjected, the shroud rings 26 and 28 can be advantageously made of materials which are different from the materials of the airfoils 24.

Figure 2:
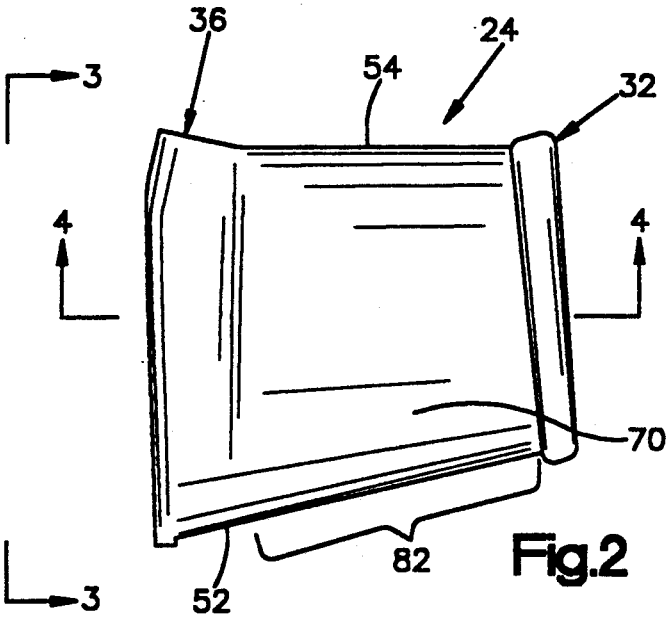
FIG. 2 is plan view of an airfoil used in the turbine engine component of FIG. 1.
Figure 3:
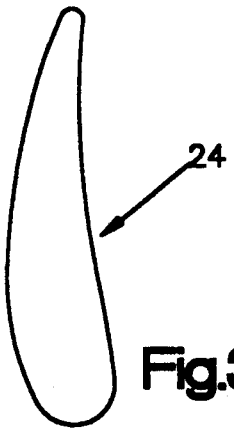
FIG. 3 is an end view, taken generally along the line 3—3 of FIG. 2, further illustrating the construction of the airfoil.

The airfoils 24 (FIGS. 2–4) are formed separately from the shroud rings 26 and 28. In the present invention, the airfoils 24 are cast as a single crystal of a nickel-chrome superalloy metal. The airfoils may be cast by a method generally similar to that disclosed in U.S. Pat. No. 3,494,709. However, it should be understood that the airfoils could be formed with a different crystallographic structure and/or of a different material if desired. For example, it is contemplated that the airfoils 24 could have a columnar grained crystallographic structure or could be formed of a ceramic or metal and ceramic material if desired The shroud rings 26 and 28 are cast separately from the airfoils 24. Therefore, the shroud rings can be formed of a metal which is different than the metal in the airfoils 24. Thus, in the specific instance described herein, the airfoils 24 are cast as single crystals of a nickel-chrome superalloy while the inner and outer shroud rings 26 and 28 were formed of a cobalt chrome superalloy, such as MAR M509. Although the inner and outer shroud rings were cast of the same metal, it is contemplated that the inner shroud ring 26 can be cast of one metal and the outer shroud ring 28 can be cast of another metal. The airfoils 24 may be formed of a third metal or a ceramic material in order to optimize the operating characteristics of the turbine engine component 20.

During operation of a turbine engine, the airfoils 24 will be heated to a higher temperature than the inner and outer shroud rings 26 and 28. Due to the fact that the airfoils are heated to a higher temperature than the inner and outer shroud rings 26 and 28, there will be a greater thermal expansion of the airfoils 24 than the shroud rings. Slip joints are provided between the outer shroud ring 28 and an outer end portion 36 (FIG. 2) of each of the airfoils 24 to accommodate thermal expansion of the airfoils. Although the slip joints are disposed between the outer shroud ring 28 and the airfoils 24 in the same manner as described in U.S. Pat. No. 4,728,258, the slip joints could be between the inner shroud ring 26 and the airfoils 24 and could have a different construction if desired.

Each of the identical airfoils 24 has a relatively wide inner end portion 32. The inner end portion 32 provides for a mechanical interconnection between the airfoils 24 and the inner shroud ring 26 throughout a substantial arcuate distance along the shroud ring 26. In addition, the bulbous configuration of the inner end portion 32 of the airfoils 24 provides for a mechanical interlock between the inner shroud ring 26 and the inner end portion of the airfoils Due to the mechanical connection between the inner end 32 of the airfoil and the shroud ring 26, the inner end portion 32 of the airfoil is anchored and cannot move radially outwardly in the inner shroud ring.

Figure 4:
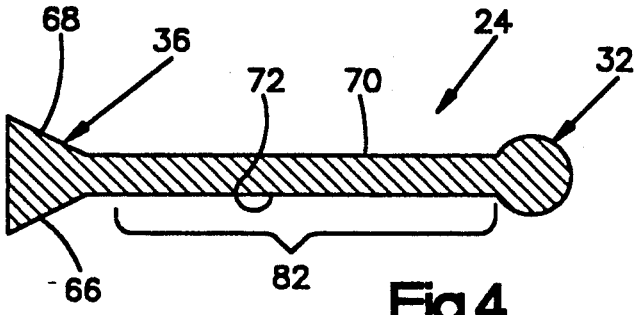
FIG. 4 is sectional view, taken generally along the line 4—4 of FIG. 2, illustrating the cross sectional configuration of a portion of the airfoil.

The outer end portion 36 of the airfoil 24 is tapered inwardly from the outer shroud ring 28 towards the inner shroud ring 26 (see FIGS. 1 and 4). Tb's, the outer end portion 36 of the airfoil has a Pair of sloping side surfaces 66 and 68 which slope radially inwardly to a concave major side surface 70 and a convex major surface 72 in a manner in which the airfoils 24 cooperate with the inner and outer shroud rings 26 and 28 to accommodate thermal expansion of airfoils relative to the shroud rings is the same as is described in U.S. Pat. No. 4,728,258 and will be further described herein to avoid prolixity of description. Although it is preferred to provide the turbine engine component 20 with slip joints in the manner described in the aforementioned United States patent, it should be understood that the present invention could be utilized in association with a turbine engine component which does not have slip joints to accommodate thermal expansion of the airfoils.

Figure 7:
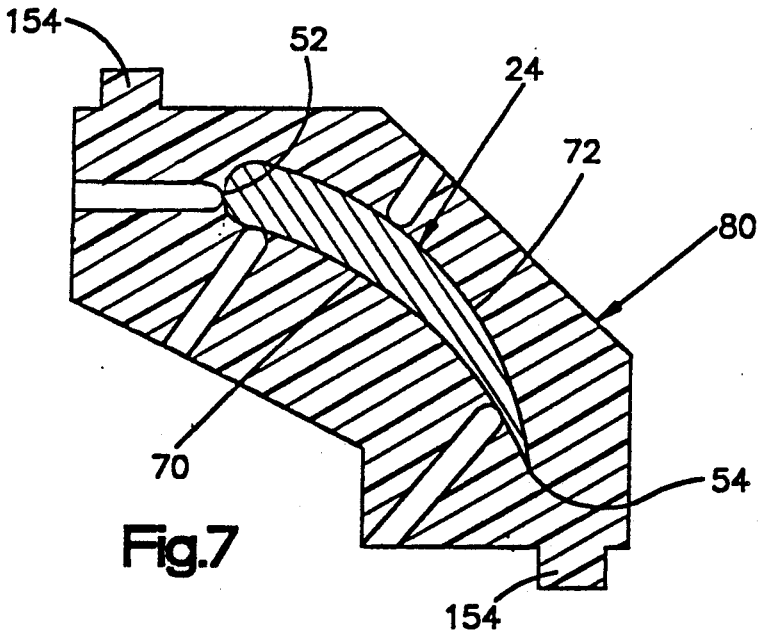
FIG. 7 is a sectional view, on the same scale as FIG. 5, illustrating the relationship of a body of positioning material to an airfoil around which the body of positioning material has been cast.
Figure 8:
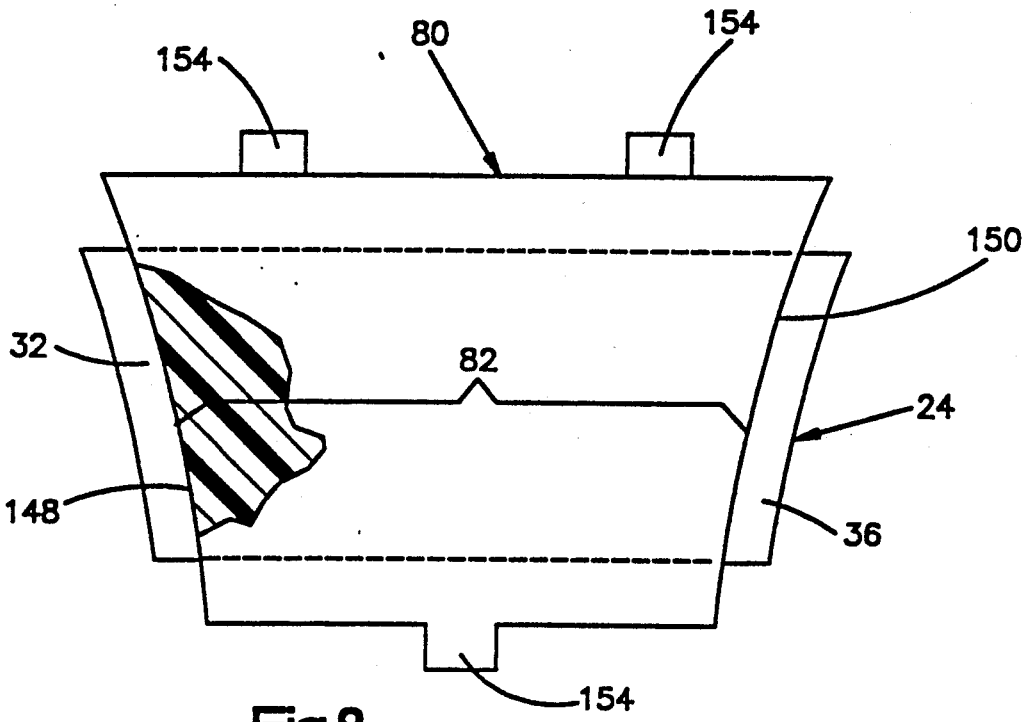
FIG. 8 is a plan view, further illustrating the relationship of the body of positioning material to the airfoil.
Figure 9:
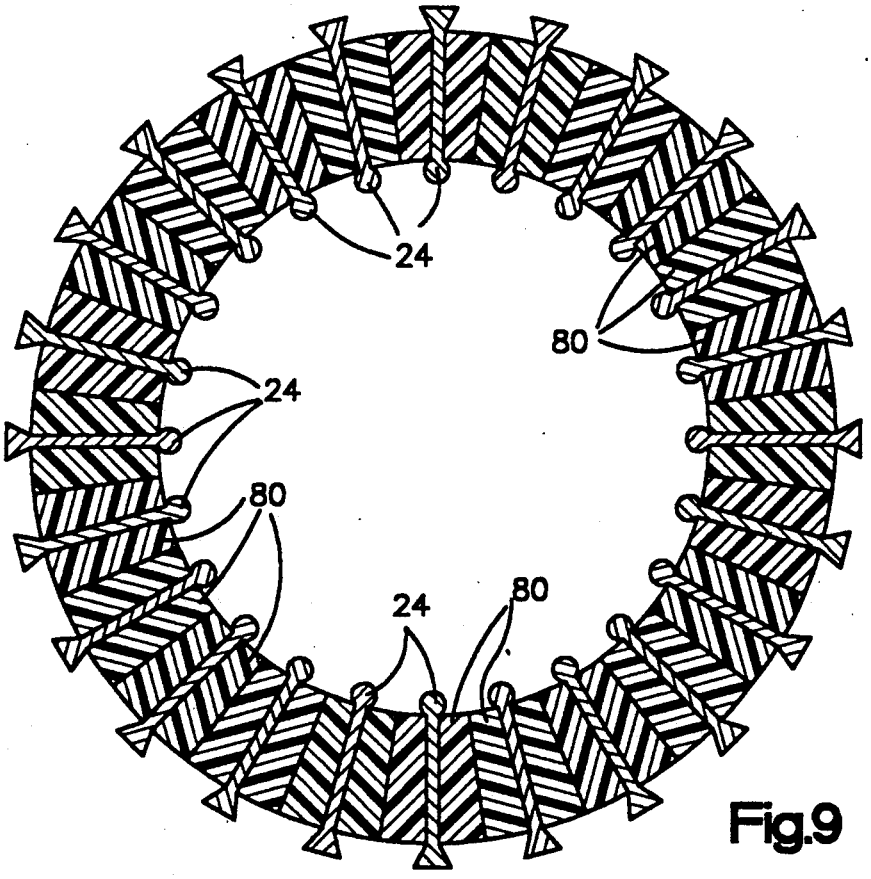
FIG. 9 is a sectional plan view illustrating the manner in which the bodies of positioning material are placed in an annular array to locate the airfoils in an annular array.
Figure 12:
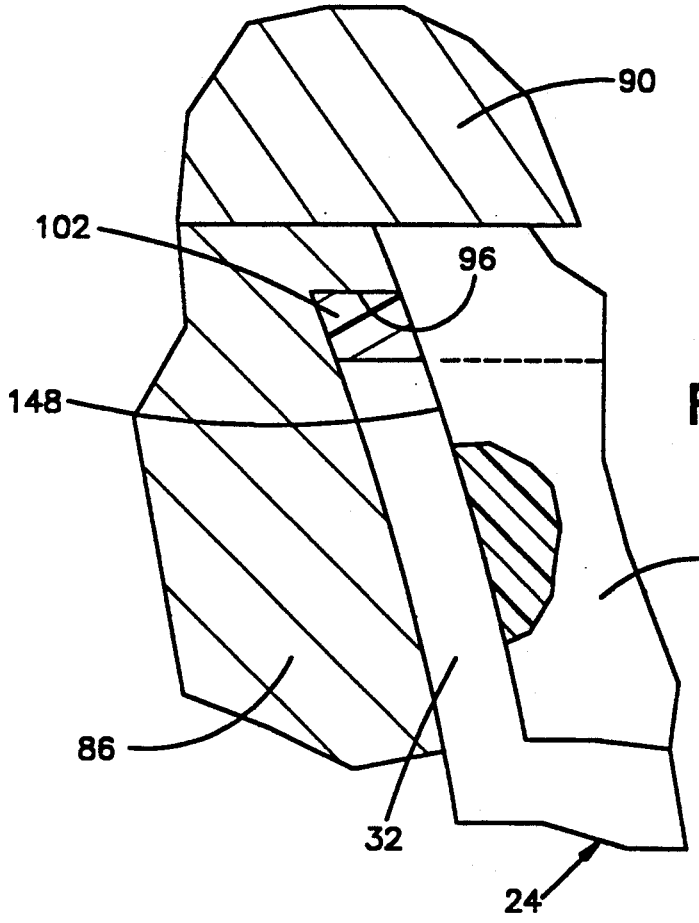
FIG. 12 is an enlarged fragmentary sectional view illustrating the manner in which an inner shroud ring pattern die cooperates with an inner portion of an airfoil and with a body of the positioning material to partially form an inner shroud ring pattern mold cavity.
Figure 13:
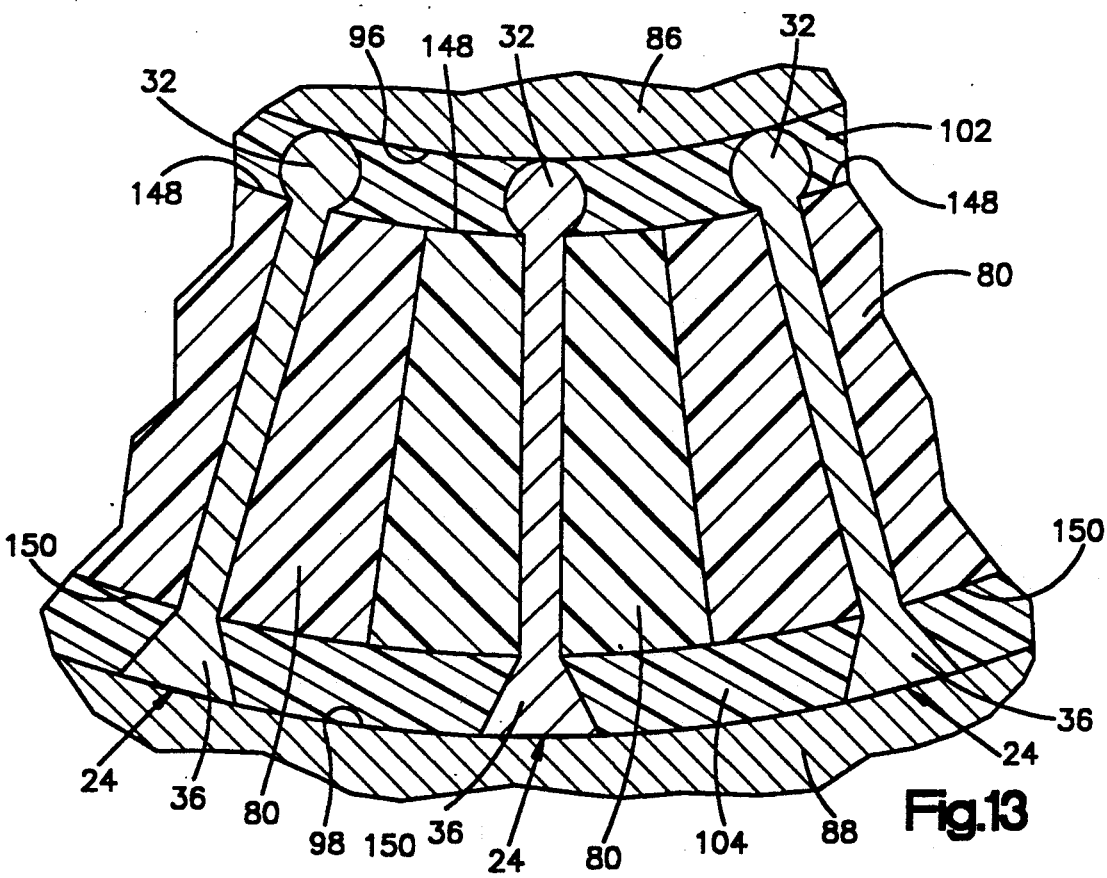
FIG. 13 is a fragmentary sectional view illustrating the in a manner in which inner and outer shroud ring patterns are molded between inner and outer shroud ring pattern dies and bodies of positioning material.

In accordance with a feature of the present invention, bodies 80 (FIGS. 5–8) of a first or positioning material are molded around a central portion 82 (FIGS. 2, 4, and 8) of each of the airfoils 24 to facilitate positioning the airfoils in an annular array (FIG. 9). The bodies 80 of positioning material are placed in engagement with each other (FIGS. 9 and 10), with inner and outer shroud ring pattern dies 86 and 88 (FIGS. 11–13), and with locating fixtures 90 and 92 to form annular cavities 96 and 98. The layer and outer shroud ring patterns 102 and 104 (FIGS. 13 and 14) are cast in the cavities 96 and 98. Once the shroud ring patterns 102 and 104 have been cast, the bodies of positioning material 80 are removed from between the airfoils 24 and from between the shroud ring patterns 102 and 104 (FIG. 13).

The annular shroud ring patterns 102 and 104 enclose the inner and outer end portions 32 and 36 of the airfoils 24. The annular inner shroud ring pattern 102 has a configuration which corresponds to the configuration of the annular inner shroud ring 26 (FIG. 1) of the turbine engine component 20. Similarly, the annular outer shroud ring pattern 104 has a configuration which corresponds to the configuration of the annular outer shroud ring 28 of the turbine engine component 20.

Figure 16:
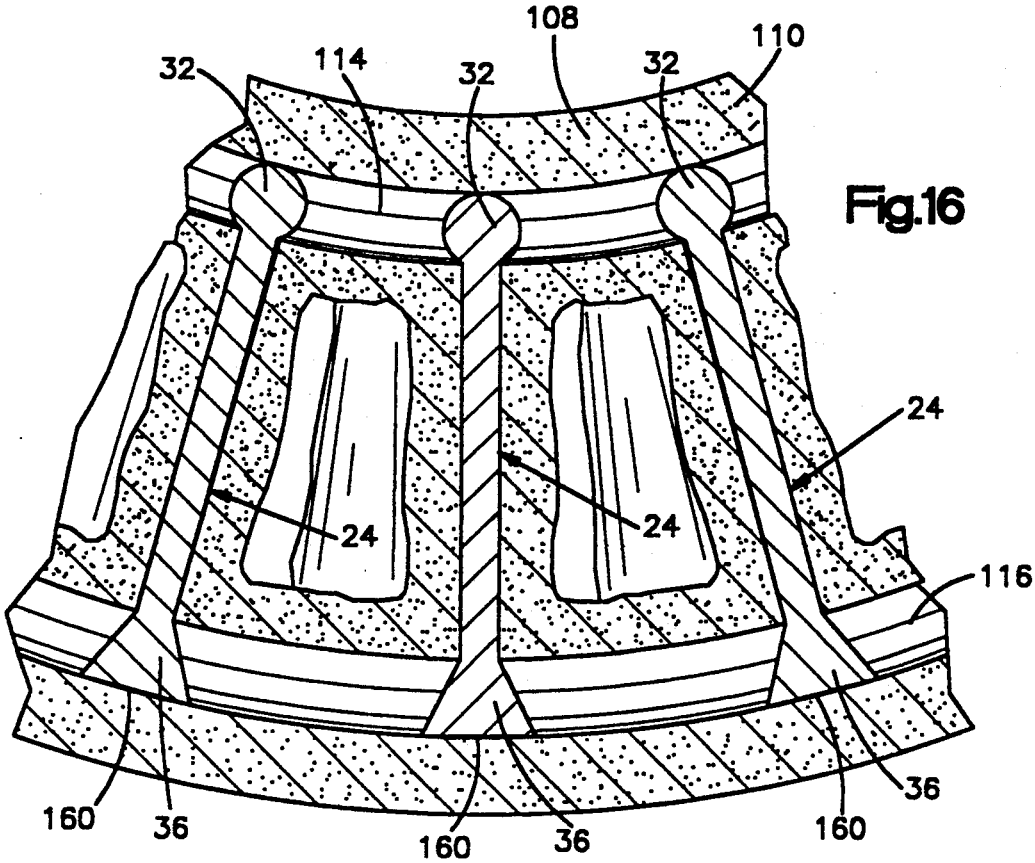
FIG. 16 is a fragmentary sectional view illustrating the relationship between the airfoils and shroud ring mold cavities formed by removing the shroud ring patterns of FIG. 15.
Figure 17:
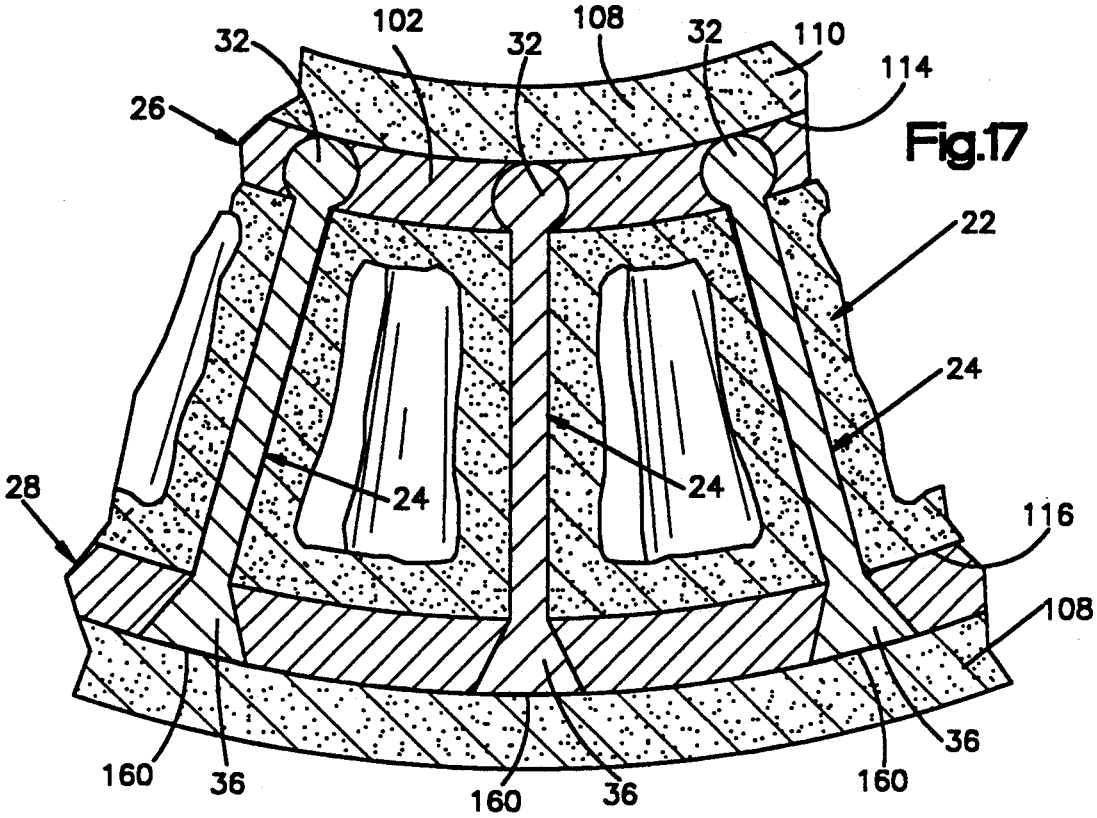
FIG. 17 is a fragmentary sectional view illustrating the relationship between the airfoils and inner and outer shroud rings cast in the shroud ring mold cavities of FIG. 16.

The shroud ring patterns 102 and 104 and the annular array 22 of airfoils 24 (FIG. 14) are covered with a ceramic mold material 108 (FIG. 15) to form a ceramic mold 110. The shroud ring patterns 102 and 104 are removed from the mold 110 to leave annular inner and outer shroud ring mold cavities 114 and 116 (FIG. 16). The inner ends 32 of the airfoils 24 are disposed in the annular inner shroud ring mold cavity 114. The outer ends 36 of the airfoils 24 are disposed in the annular outer shroud ring mold cavity 116. Molten metal is conducted from a suitable gating system into the inner and outer shroud ring mold cavities 114 and 116 to form the inner and outer shroud rings 26 and 28 (FIG. 17).

The spatial relationship between the airfoils 24 and/or between the annular array 22 of airfoils and the inner and outer shroud rings 26 and 28 can be readily changed by changing the orientation of the airfoils relative to a secondary mold cavity 130 (FIGS. 5 and 6) in which the bodies 80 of positioning material are cast. Changing the orientation of the airfoils 24 relative to the secondary mold cavity 130 changes the orientation of the airfoils relative to the positioning bodies 80 (FIG. 7).

When the positioning bodies 80 are placed in annular array (FIG. 9), the positioning bodies 80 are always located in the same relationship relative to each other. Thus, the positioning bodies 80 are positioned in abutting engagement with each other and are engaged by suitable fixtures 90 and 92 (FIG. 11) to locate the positioning bodies 80 in a predetermined relationship with each other. Although it is preferred to arrange the positioning bodies 80 in an annular array, the positioning bodies could be placed in a segment of an annular array to enable the turbine engine component 20 to be formed one segment at a time.

If the orientation of the airfoils 24 relative to the positioning bodies 80 is changed, the orientation of the airfoils 24 relative to each other will be changed when the positioning bodies are placed in an annular array. This allows the spatial relationship between the airfoils 24 to be changed. Thus, by merely changing the angle at which the airfoils 24 are positioned in the secondary mold cavity 130 (FIG. 5) the angle between adjacent airfoils in the annular array 22 of airfoils can be changed.

Raising or lowering the position of the airfoils 24 (FIG. 5) in the secondary mold cavity 130 results in a raising or lowering of the annular array 22 of airfoils relative the inner and outer shroud rings 26 and 28. Thus, by merely changing the positions of the airfoils 24 in the bodies 80 of positioning material, the spatial relationship between the airfoils 24 and inner and outer shroud rings 26 and 28 can be varied from one turbine component to the next. This allows different turbine components to be formed with the airfoils 24 in different spatial relationships relative to each other and/or relative to the shroud rings 26 and 28.

Since the orientation of the airfoils 24 in a turbine engine component 20 can be changed by merely changing the positions of the airfoils in the bodies 80 of positioning material, it is possible to make one turbine engine component with the airfoils in a first orientation and a second turbine engine component with the airfoils in another orientation. This can be done without changing expensive fixtures and/or dies. The airfoils for the second turbine engine component are merely located in a different orientation in the secondary mold cavity 130 (FIG. 5) than the airfoils for the first turbine engine component.

Forming Bodies of Positioning Material

When the turbine engine component 20 is to be constructed, a plurality of preformed airfoils 24 are provided. Each of the airfoils 24 is sequentially positioned in the secondary mold cavity 130 (FIG. 5) to enable a body 80 of positioning material to be molded around the airfoil.

Prior to positioning of the airfoil 24 in the secondary chamber 130, a desired spatial relationship between the airfoils 24 in the annular array 22 of airfoils is selected. Once a desired spatial relationship has been selected, positioning rods 136 (FIG. 5 and 6) are adjusted relative to upper and lower main die sections 138 and 140. In addition, positioning rods 136 are adjusted relative to left and right end die sections 142 and 144.

Figure 5:
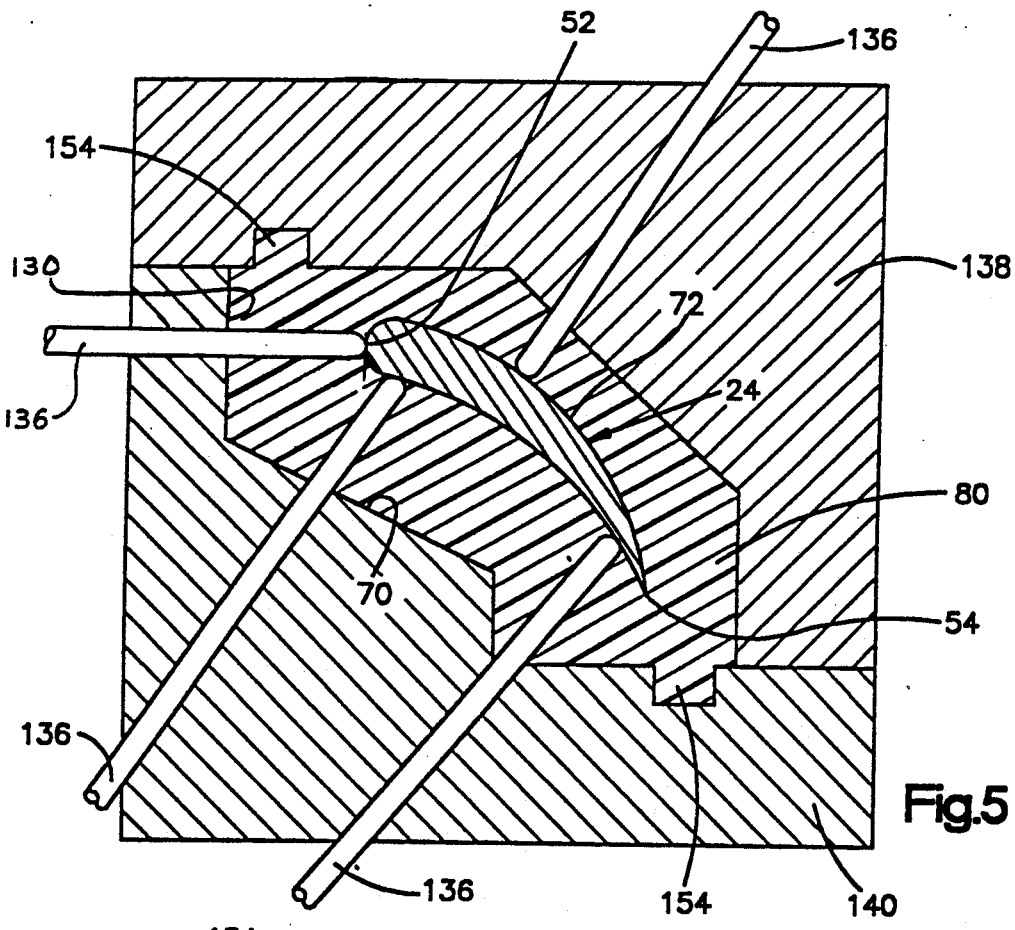
FIG. 5 is a sectional view illustrating the relationship of the airfoil of FIGS. 2–4 to a mold cavity in which a body of positioning material is cast around the airfoil.

Once the locations of the positioning rods 136 relative to the die sections 138–144 have been set, the concave major side surface 70 of an airfoil 24 is positioned in abutting engagement with the positioning rods 136 on the lower main die section 140 (FIG. 5). It should be understood that although only the two positioning rods 136 have been shown in association with the lower main die section 140, there are at least three positioning rods 136 associated with the lower main die section 140.

The upper main die section 138 is then positioned relative to the lower main die section 140 (FIG. 5). Positioning of the upper main die section 138 relative to the lower main die section 140 moves positioning rods 136 connected with the upper main die section 138 into abutting engagement with the convex upper major side surface 72 of the airfoil 24. In addition, the positioning rods 136 connected with the upper die section 138 engage the leading edge portion 52 of the airfoil 24. A pair of positioning rods (not shown) connected with the lower main die section 140 engage the trailing edge 54 of the airfoil 24.

Figure 6:
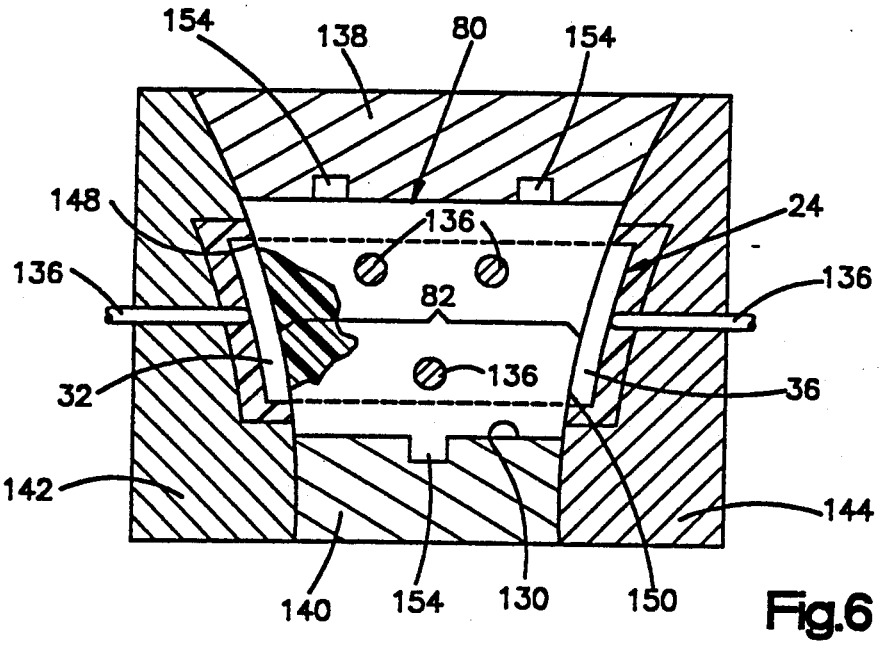
FIG. 6 is a plan view, on a reduced scale, further illustrating the relationship of the airfoil to the mold cavity of FIG. 5.

Once the upper and lower main die sections 138 and 140 have been positioned around the airfoil 24 in the manner as shown in FIG. 5, left and right end die sections 142 and 144 are positioned around the airfoil 24 (FIG. 6). The left end die section 142 supports a positioning rod 136 which engages the inner end portion 32 of the airfoil 24. Similarly, the right end die section 144 supports a positioning rod 136 which engages the outer end portion 36 of the airfoil 24. The left and right end sections 142 and 144 engage the upper and lower main die sections 138 and 140 to accurately position the end die sections relative to the main die sections. This results in the airfoils 24 being accurately located in the secondary mold cavity 130.

The upper and lower main die sections 138 and 140 cooperate to provide a relatively large central portion of the mold cavity 130. The end die sections 142 and 144 form portions of the mold cavity 132 which are only slightly larger than the inner and outer end portions 32 and 36 of the airfoil 24. This results in the body 80 of positioning material having a relatively thick main section which encloses the central portion of the airfoil 24.

The body 80 of positioning material has relatively thin left and right end sections which enclose the inner and outer end portions 32 and 36 of the airfoil 24. The resulting shoulders (FIG. 6) on the body 80 of positioning material have side surfaces 148 and 150 which extend transversely to the major sides 70 and 72 of the airfoil 24 and cooperate with the inner and outer shroud ring pattern dies 86 and 88 (FIG. 10) to form the inner and outer ring pattern mold cavities 96 and 98.

The thin layer of the body of positioning material overlying the inner and outer end portions 32 and 36 of the airfoil 24 are removed before the inner and outer shroud pattern dies 86 and 88 (FIG. 10) are moved into engagement with the portions 32 and 36 of the airfoil 24. Since the layers of positioning material overlying the end portions 32 and 36 of the airfoils 24 are thin, it is a relatively easy matter to remove these layers of positioning material without damaging the relatively thick main section of the body of positioning material. This exposes the surfaces on the end portions 32 and 36 of the airfoils for engagement by the shroud ring pattern material (see FIGS. 11 and 12).

The orientation of an airfoil 24 in the secondary mold cavity 130 (FIGS. 5 and 6) can be adjusted by adjusting the location of the positioning rods 136 relative to the die sections 138, 140, 142, and 144. Thus, if the angle of the airfoil 24 relative to an adjacent airfoil is to be changed, the positioning rods 136 engaging the convex side surface 70 the airfoil 24 adjacent to the trailing edge 54 (FIG. 5) may be extended while the positioning rods 136 engaging the convex side 74 of the airfoil 24 adjacent to the leading edge are retracted. Corresponding adjustments would be made in the positioning rods engaging the convex side 72 in the airfoil 24. The cavities in the left and right end die sections 142 and 144 exceed the size of the end portions 132 and 136 in the airfoil 24 by an amount sufficient to enable the airfoil to be tilted through an angle of approximately six or more degrees relative to the mold cavity 130 to accommodate changing the angle of the airfoil 24.

If the position of the airfoil 24 was to be changed relative to the inner and outer shroud rings 26 and 28, all of the positioning rods 136 in the lower die section 140 would be either extended or retracted. A corresponding adjustment would be made in the positioning rods 136 in the upper die section 138. If desired, the axial position of the airfoil 24 relative to a body 80 of positioning material can be changed by adjusting the positioning rods 136 in the left and right end sections 142 and 144.

The adjustable positioning rods 136 enable the same die sections 138, 140, 142, and 144 to be used to locate airfoils 24 in many different positions relative to bodies 80 of positioning material. This enables the die sections 138–144 to be used to position airfoils 24 for turbine components in which the airfoils have different orientations. Therefore, it is possible to change the spatial relationship between airfoils in different turbine engine components without replacing the dies 138–140.

When the airfoil 24 has been accurately positioned in the secondary mold cavity 130, hot liquid wax is injected under pressure into the secondary mold cavity. A body of liquid wax almost completely surrounds the airfoil 24. Although the wax surrounds the airfoil 24, the body of wax or positioning material 80 has a relatively thick central portion 82 (FIG. 6) which extends between the inner and outer end portions 32 and 36 of the airfoil 24. The body of liquid wax in the secondary mold cavity also includes relatively thin portions which overly the inner and outer end portions 32 and 36 of the airfoil 24. The molten wax is solidified in the secondary mold cavity 130 to form the body 80 of positioning material (FIG. 7).

Although many different types of waxes could be used to from the body 80 of positioning material, it is preferred to use a water soluble wax, such as a glycol based wax. In one specific instance, the wax which was used to form the body 80 of positioning material was "Cerita 484-S" water soluble wax obtained from Argueso Corporation of Manaroneck, N.Y. Of course, other known waxes or other materials could be used if desired.

Forming Shroud Ring Patterns

In order to form the shroud patterns 102 and 104 (FIG. 12) is necessary to first place the airfoils 24 in an annular array. This is done by placing the bodies 80 of positioning material in an annular array. Thus, the bodies 80 of positioning material are used to locate the airfoils 24 relative to each other. If it was desired to form the turbine engine component 20 in segments, the positioning bodies would be placed in segments of an annular array.

Figure 10:
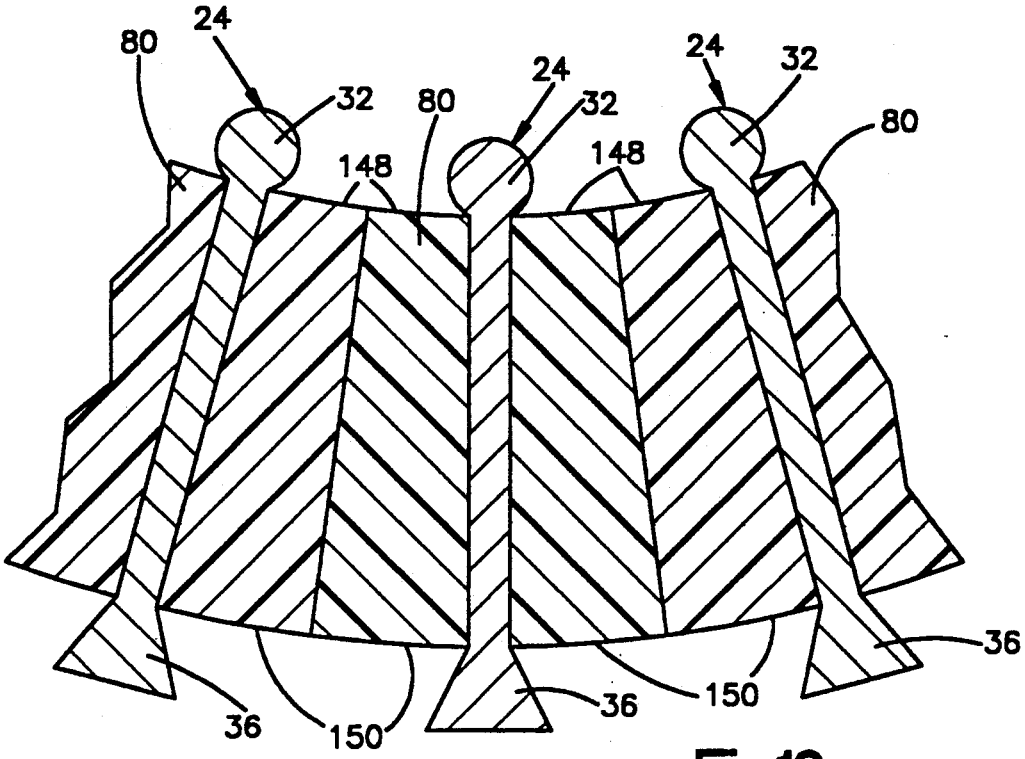
FIG. 10 is an enlarged fragmentary sectional view of a portion of FIG. 9 illustrating the manner in which the bodies of positioning material enclose the airfoil and are placed in abutting engagement to locate the airfoils in an annular array.

In order to facilitate placing the bodies 80 of positioning material in an annular array, the bodies are provided with a plurality of locating lugs 154 which project outwardly from opposite sides of the bodies (FIG. 8). The locating lugs 154 are engaged by suitable fixtures to accurately locate the bodies 80 of positioning material in an annular array. The bodies 80 of positioning material are also located in the annular array by abutting engagement between outer side surfaces of the bodies of positioning material (FIG. 9 and 10).

The orientation of the airfoils 24 relative to each other is determined by their orientation in the bodies 80 of positioning material Thus, the locating lugs 154 on outer side surfaces of the bodies 80 of positioning material are used to accurately locate the bodies of positioning material relative to each other. Although it is preferred to have the outer side surfaces of the bodies 80 of positioning material in abutting engagement as shown in FIG. 9, it is contemplated that a suitable fixture could be provided with side walls which engage each of the bodies of positioning material to accurately locate the bodies relative to each other without relying on abutting engagement between the outer side surfaces of the bodies of positioning material.

Since the bodies 80 of positioning material are accurately located relative to each other and since the airfoils 24 are accurately located in the bodies of positioning material, the airfoils are accurately located relative to each other. It is contemplated that, for any one turbine engine component 20, the airfoils 24 will all be disposed in the same spatial relationship relative to each other. Thus, the airfoils 24 for any one turbine engine component 20 will all be located in the same position relative to the secondary mold cavity 130 by the positioning rods 136 (FIG. 5). The results in the airfoils 24 all being in the same position relative to each other.

When the bodies 80 of positioning material have been disposed in an annular array (FIG. 9), annular upper and lower shroud pattern dies or fixtures 90 and 92 (FIG. 11) engage the projections 154 to accurately locate the bodies 80 of positioning material and the airfoils 24 relative to each other. Segments of annular inner and outer shroud ring pattern dies 86 and 88

(FIGS. 11 and 13) are then moved into engagement with opposite end portions 32 and 36 of each of the airfoils 24. The annular inner and outer shroud ring pattern dies 86 and 88 are disposed in abutting engagement with opposite side surfaces 148 and 150 (FIG. 11) on the bodies 80 of positioning material.

The thin layers of positioning material which were molded over the inner and outer end portions 32 and 36 of the airfoils 24 in the secondary mold cavity 130 have been removed to expose the inner and outer end portions 32 and 36 of the airfoils 24. This allows the inner and outer die sections 86 and 88 to abuttingly engage opposite ends of the airfoils 24. It should be understood that although only a pair of inner and outer shroud ring pattern die sections 86 and 88 have been shown in FIG. 11, there is an inner annular array of shroud ring pattern die sections 86 in engagement with the inner end portions of the airfoils 24 and an outer annular array of shroud ring pattern die sections 88 in abutting engagement with the outer end portions 36 of the airfoils 24.

Figure 11:
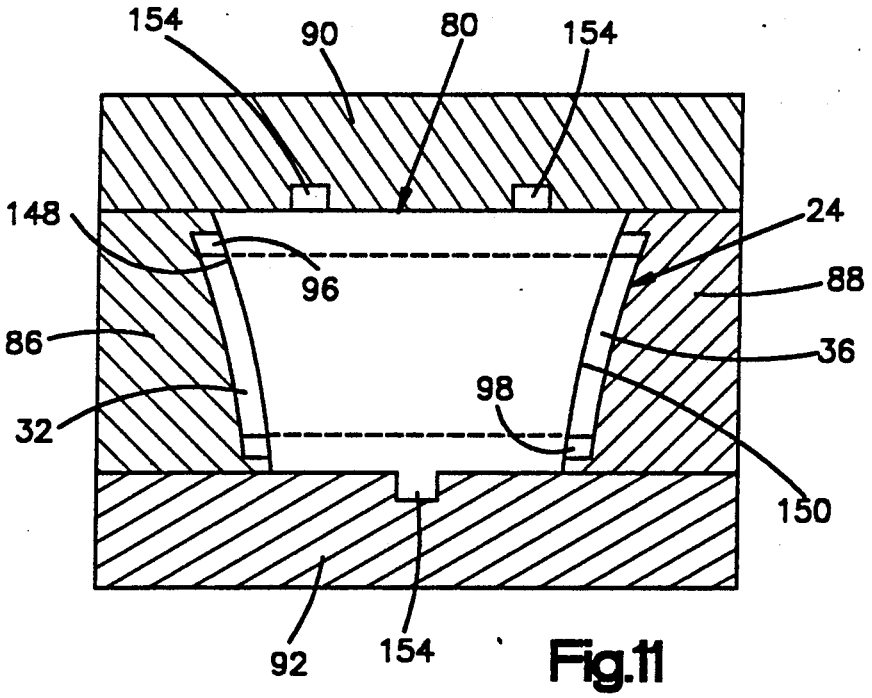
FIG. 11 is a schematic sectional view illustrating the manner in which inner and outer shroud ring pattern dies cooperate with a body of the positioning material to partially form annular inner and outer shroud ring pattern mold cavities.

The pattern die sections 86 and 88 engage the side surfaces 148 and 150 on the bodies 80 of positioning material to form annular inner and outer shroud ring pattern mold cavities 96 and 98 (FIG. 11). The annular inner shroud ring mold cavity 96 has the same configuration as the inner shroud ring 26 and is formed between the inner shroud ring pattern die 86 and the side surface 148 on the bodies 80 of positioning material surrounding the airfoils 24. Similarly, the annular outer ring shroud ring mold cavity 98 has the same configuration as the outer shroud ring 28 and is formed between the outer shroud ring pattern die 88 and the side surface 150 on the bodies 80 of positioning material.

Hot liquid shroud ring pattern material (wax) is injected into the annular inner and outer shroud ring pattern mold cavities 96 and 98. Thus, the shroud ring pattern material flows into the inner shroud ring pattern mold cavity 96 and engages the side surface 148 of the bodies 80 of positioning material. The shroud ring pattern material also engages exposed inner end portion 32 on the airfoils 24 and the inner shroud ring pattern dies 86 (FIG. 12). The shroud ring pattern material is cooled and solidified in the inner shroud pattern mold cavity 96 to form a one-piece annular inner shroud ring pattern 102 (FIG. 13) having the same configuration as the inner shroud ring 26.

Similarly, hot liquid shroud ring pattern material (wax) is injected into the outer shroud ring mold cavity 98 (FIG. 11). As the shroud ring Pattern material flows into the outer shroud ring mold cavity 98, the shroud ring pattern material engages the side surfaces 150 on the bodies 80 of positioning material. The shroud ring pattern material also engages the exposed outer end portions 36 of the airfoils 24 and the outer ring pattern dies 88 (FIG. 13). The shroud ring pattern material is cooled and solidified in the outer shroud ring pattern mold cavity 98 to form a one-piece annular outer shroud ring pattern 104 (FIG. 12) having the same configuration as the outer shroud ring 28.

The inner and outer shroud ring patterns 102 and 104 enclose the inner and outer end portions 32 and 36 of the airfoils 24. In addition, the inner and outer shroud ring patterns 102 and 104 enclose the inner and outer side surfaces 148 and 150 of the bodies 80 of positioning material disposed in the annular array annular array (FIG. 13).

The inner and outer shroud ring patterns 102 and 104 (FIG. 13) are each molded as one annular piece of shroud ring pattern material. Thus, the inner shroud ring pattern 102 is cast as one piece of shroud ring pattern material in the annular inner shroud ring pattern mold cavity 96. Similarly, the outer shroud ring pattern 104 is cast as one piece of annular shroud ring mold material in the outer shroud ring pattern cavity 98. The one piece annular inner and outer shroud ring patterns 102 and 104 are accurately molded to have configurations corresponding to the desired configurations of the inner and outer shroud rings 26 and 28.

The pattern material used to form the inner and outer shroud ring patterns 102 and 104 is not soluble in water. Either a natural or synthetic wax may be used to form the inner and outer shroud ring patterns 102 and 104. In one specific instance, the wax which was used to form the shroud ring patterns 102 and 104 was "Pattern Wax 701" obtained from Argueso Corporation of Manaroneck, N.Y. Of course other known waxes or other materials could be used if desired.

After the inner and outer shroud ring patterns 102 and 104 have been molded in the manner previously explained, the inner and outer shroud pattern dies 86 and 88 are disengaged from the one piece cast inner and outer shroud ring patterns 102 and 104. This results in the circular inner side surface of the inner shroud ring pattern 102 being exposed and the circular outer side surface of the outer shroud ring pattern 104 being exposed. At this time, the bodies 80 of positioning material are disposed between the inner and outer shroud ring patterns 102 and 104 and between the airfoils 24 (FIG. 13).

Since the bodies 80 of positioning material do not correspond to portions of the turbine engine component 20, the bodies of positioning material are removed from between the shroud ring patterns 102 and 104. To facilitate removal of the bodies 80 of positioning material, the bodies of positioning material are formed of a water soluble wax while the inner and outer shroud ring patterns 102 and 104 are formed of a wax which is not water soluble. This enables the bodies 80 of positioning material to be removed from between the shroud ring patterns 102 and 104 by merely dissolving the bodies 80 of positioning material with water. Of course the bodies 80 of positioning material could be completely or partially removed by mechanical means if desired.

When the bodies 80 of positioning material have been removed from between the shroud ring patterns 102 and 104 (FIG. 14), the central portions of the airfoils 24 are exposed. At this time, only the end Portions 32 and 36 of the airfoils are enclosed by shroud ring pattern material. Thus, the inner end portions 32 of the airfoils 24 are enclosed by the annular inner shroud ring pattern 102. The outer end portions 36 of the airfoils 24 are enclosed by the annular outer shroud ring pattern 104.

Forming Ceramic Molds

Figure 14:
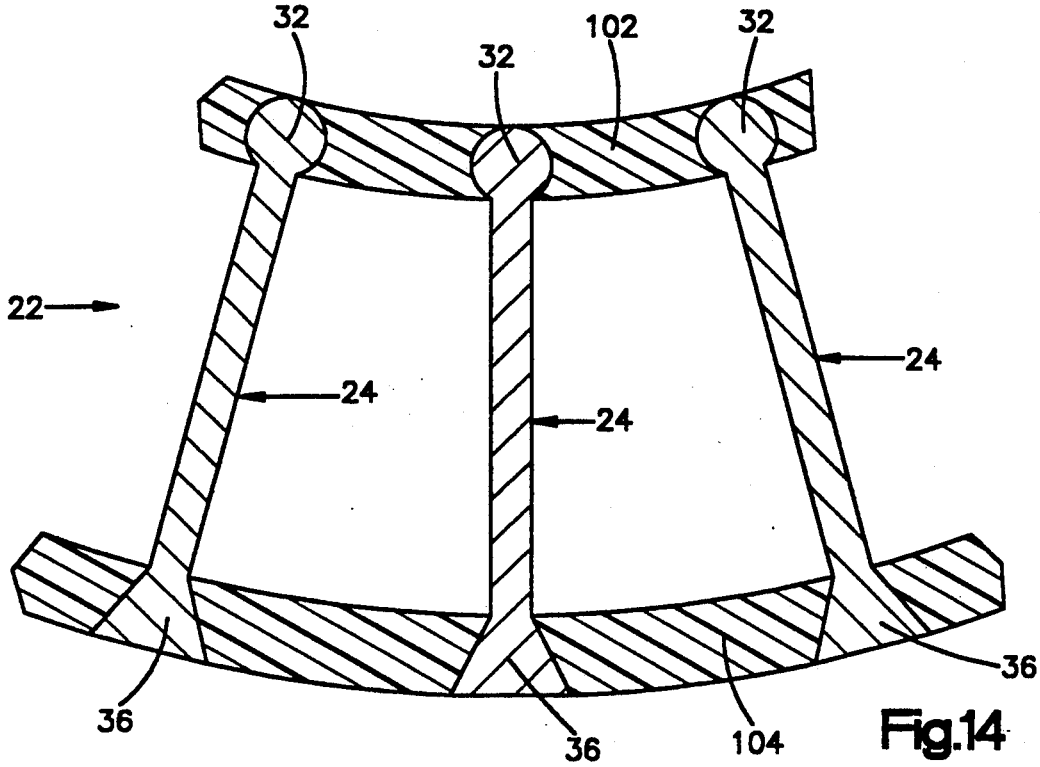
FIG. 14 is a fragmentary sectional view generally similar to FIG. 13, illustrating the relationship between inner and outer shroud ring patterns and the airfoils after the bodies of positioning material have been removed.
Figure 15:
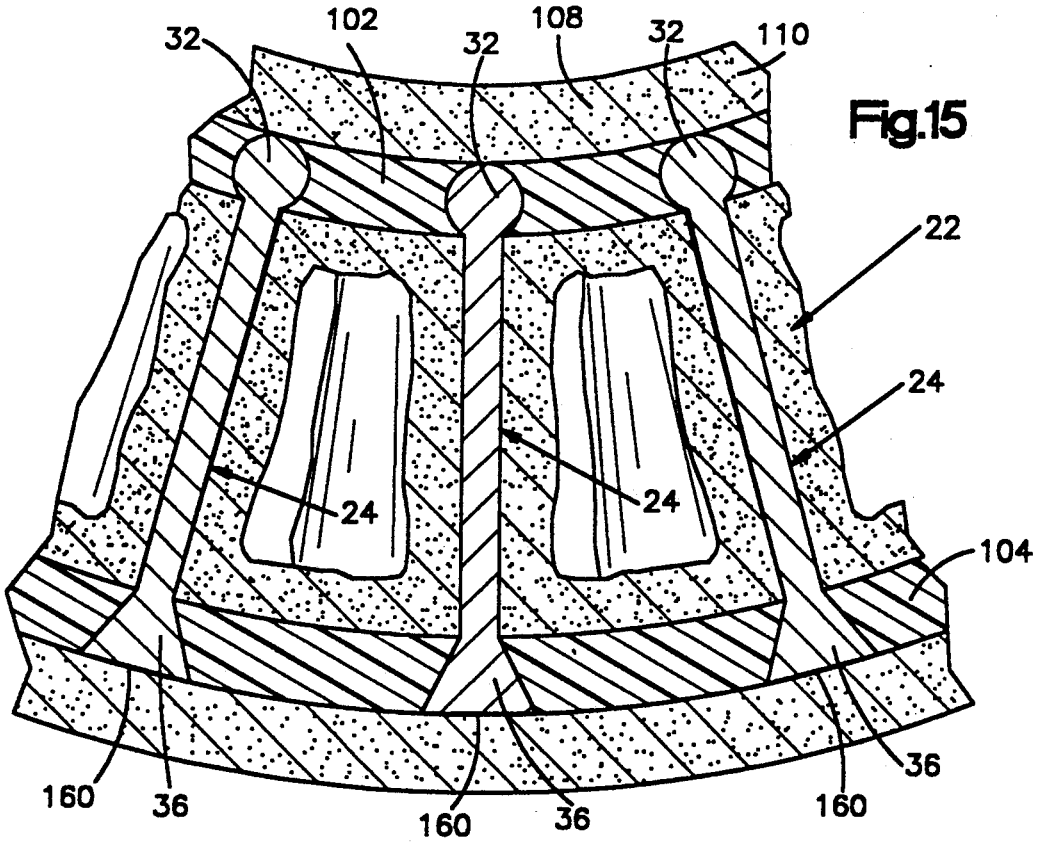
FIG. 15 is a fragmentary sectional view illustrating the manner in which ceramic mold material covers the airfoils and inner and outer shroud ring patterns.

In order to form the mold 110, the inner and outer shroud ring patterns 102 and 104 and airfoils 24 (FIG. 14) are completely covered with liquid ceramic mold material 108 (FIG. 15). In addition, the ceramic mold material 108 covers a gating system pattern (not shown) connected with the inner and outer shroud ring patterns 102 and 104. The entire pattern assembly may be covered with the liquid ceramic mold material by repetitively dipping the pattern assembly in a series of liquid ceramic mold materials.

Although many different types of ceramic mold materials could be utilized, one specific ceramic mold material contains fused silicon, zircon, and other refractory materials in combination with binders. Chemical binders such as ethyl silicate, sodium silicate, and colloidal silica can be utilized. In addition the slurry may contain suitable film formers, such as alginates, to control viscosity and wetting agents to control flow characteristics and pattern wettability.

The ceramic mold material 108 overlies and is in direct engagement with the major side surfaces 70 and 72 of the metal airfoils 24. In addition, the mold material overlies exposed outer end surfaces 160 on the outer end portions 36 of the airfoils (FIG. 15). Due to the inwardly tapered configuration of the outer end portions 36 of the airfoils 24, the ceramic mold material overlies the end portions where their cross sectional areas are a maximum. The ceramic mold material completely encases the inner and outer shroud ring patterns 102 and 104.

After the ceramic mold material 108 has at least partially dried, the mold 110 is heated to melt the wax material of the inner and outer shroud ring patterns 102 and 104 and the gating system pattern. The melted wax is poured out of the mold 110 through an opening in the gating system. This completes the formation of the annular inner and outer shroud ring mold cavities 114 and 116 (FIG. 16). The annular shroud ring mold cavities 114 and 116 have a configuration corresponding to the configuration of the inner and outer shroud patterns 102 and 104 and the inner and outer shroud rings 26 and 28 of the turbine engine component 20.

The mold 110 is then fired in a temperature of approximately 1,900° F. for a time sufficient to cure the mold 110. This results in the airfoils 24 being securely held in place relative to the inner and outer shroud ring mold cavities 114 and 116 by the rigid ceramic mold material 108.

Once the mold 110 has been formed in the manner previously described, molten metal is poured into the mold through the gating system. The molten metal flows through the gating system into the inner and outer shroud ring mold cavities 114 and 116. While the molten metal is flowing into the shroud ring mold cavities 114 and 116 (FIG. 16), the airfoils 24 are held against movement relative to each other and to the mold cavities by the ceramic mold material 108 engaging major side surfaces 70 and 72 of the airfoils. The molten metal does not engage the outer end surfaces 160 of the airfoils 24 since these surfaces are covered by the ceramic mold material 108. However, the molten metal in the inner and outer shroud ring mold cavities 114 and 116 goes completely around each of the airfoils 24 so that the end portions 32 and 36 of the airfoils are circumscribed by the molten metal.

During solidification of the molten metal in the shroud ring mold cavities 114 and 116, a metallurgical bond does not form between the inner and outer shroud rings 26 and 28 (FIG. 16) and the end portions 32 and 36 of the airfoils 24. This is because the outer surfaces of the airfoils are covered with an oxide coating which is formed during handling of the airfoils in the atmosphere. This oxide coating prevents the forming of a metallurgical bond between the airfoils 24 and the inner and outer shroud rings 26 and 28. Therefore, there only a mechanical bond between the inner and outer shroud rings 26 and 28 and the end portions 32 and 36 of the airfoils 24.

Molten metal which solidifies to form the inner and outer shroud rings 26 and 28 has a different composition than the composition of the airfoils. Thus, the airfoils are formed of a nickel-chrome alloy. The inner and outer shroud rings 26 and 28 are formed of a cobalt chrome superalloy. Although the shroud rings 26 and 28 are formed of the same metal, they could be formed of different metals if desired. If the shroud rings 26 and 28 are to be formed of different metals, two separate gating systems would have to be provided, that is one gating system for the inner shroud ring mold cavity 114 and a second gating system for the outer shroud ring mold cavity 116. Once the molten metal has solidified, the turbine engine component 20 is removed form the mold 110.

It is contemplated that an engine designer may want to evaluate a turbine engine component which is the same as the turbine engine component 20 (FIG. 1), with exception that the airfoils 24 are in a slightly different orientation relative to each other. The present invention allows this to be quickly and easily done without obtaining new fixtures and/or dies. Thus, it is merely necessary to adjust the positioning rods 136 (FIGS. 5 and 6) to locate the airfoils 24 for the revised turbine engine component in a different orientation relative to the secondary mold cavity 130. The shroud ring pattern dies 86, 88, 90, and 92 can be used with the bodies 80 of material in which the airfoils are located in a somewhat different orientation.

Conclusion

The present invention provides a method of making turbine engine components wherein the spatial relationship between airfoils 24 and shroud rings 26 and 28 can be changed without replacing expensive tooling and/or dies which were previously used during forming of the shroud ring patterns 102 and 104. This is accomplished by molding bodies 80 of positioning material around the central portions 82 of the airfoils 24. The bodies 30 of positioning material are utilized to locate the airfoils 24 relative to each other during positioning of the airfoils in an annular array (FIG. 9).

After the airfoils 24 have been positioned in an annular array, dies 86, 88, 90, and 92 cooperate with the positioning material to form annular inner and outer shroud ring pattern mold cavities 96 and 98 into which inner and outer end portions 32 and 36 of the airfoils 24 extend (FIG. 13). The annular shroud ring pattern mold cavities 96 and 98 are filled with pattern material which engages the bodies 80 of positioning material and the inner and outer end portions 32 and 36 of the airfoils. This pattern material is solidified to form inner and outer shroud ring patterns 102 and 104. The positioning bodies 80 are then removed from between the airfoils 24 (FIG. 14).

The inner and outer shroud ring patterns 102 and 104 are then covered with a ceramic mold material (FIG. 15) to form a mold 107. The shroud ring patterns 102 and 104 are then removed from the mold 110 to leave annular shroud ring mold cavities 114 and 116 (FIG. 16). Molten metal is conducted into the annular shroud ring mold cavities to form the inner and outer shroud rings 26 and 28 (FIG. 17).

Having described specific preferred embodiments of the invention, the following is claimed:

1. A method of making a turbine engine component having a plurality of airfoils disposed in an array, said method comprising the steps of providing a plurality of airfoils, solidifying a first material around and in engagement with the airfoils, solidifying pattern material around and in engagement with the airfoils, said step of solidifying the pattern material around the airfoils including at least partially shaping the pattern material by engagement of the pattern material with the first material and with the airfoils, removing the first material from around the airfoils, thereafter, covering the pattern material with mold material to at least partially form a mold, removing the pattern material from the mold to leave a mold cavity with an end portion of each of the airfoils at least partially disposed in the mold cavity, filling the mold cavity left by removal of the pattern material with molten metal which extends around end portions of the airfoils, and solidifying the molten metal in the mold cavity.

2. A method as set forth in claim 1 wherein said step of solidifying a first material around the airfoils includes molding a separate body of the first material around each the airfoils, said method further including the step of positioning the separate bodies of the first material in an annular array to position the airfoils in an annular array.

3. A method as set forth in claim 2 wherein said step of solidifying pattern material around the airfoils includes solidifying a circular body of pattern material around end portions of the airfoils after performing said step of positioning the separate bodies of a first material in an annular array.

4. A method as set forth in claim 1 wherein said step of solidifying pattern material around the airfoils includes solidifying a circular body of pattern material around end portions of the airfoils.

5. A method as set forth in claim 1 wherein said step of shaping the pattern material by engagement of the pattern material with the first material includes engaging the first material with liquid pattern material.

6. A method as set forth in claim 1, wherein said step of solidifying pattern material around the airfoils includes solidifying a continuous circular body of pattern material around end portions of the airfoils, said step of removing the pattern material from the mold to leave a mold cavity includes removing the circular body of pattern material from the mold to leave a circular mold cavity with end portions of the airfoils disposed in the circular mold cavity.

7. A method as set forth in claim 1 wherein said step of solidifying a first material around the airfoils includes positioning at least a portion of the airfoils in a secondary mold cavity and filling the secondary mold cavity with the first material.

8. A method as set forth in claim 1 further including the step of positioning the airfoils in an annular array, said step of solidifying pattern material around the airfoils including solidifying an annular body of pattern material which engages each of the airfoils in the annular array of airfoils to form a one piece body of pattern material connected with each of the airfoils in the annular array of airfoils.

9. A method as set forth in claim 1 wherein said step of solidifying a first material around the airfoils includes at least almost completely enclosing each of the airfoils with the first material, said method further including removing from the airfoils portions of the first material overlying surface areas on each of the airfoils, said step of solidifying pattern material around the airfoils includes solidifying the pattern material with the pattern material in engagement with the surface areas from which the first material was removed.

10. A method of making a turbine engine component having a plurality of airfoils disposed in an annular array between inner and outer shroud rings, said method comprising the steps of providing a plurality of airfoils having leading and trailing edge portions extending between inner and outer end portions of the airfoils, positioning the airfoils in an annular array, molding a one piece annular inner shroud ring pattern around the inner end portions of the airfoils while the airfoils are disposed in the annular array, molding a one piece annular outer shroud ring pattern around outer end portions of the airfoils while the airfoils are disposed in the annular array, covering the inner and outer shroud ring patterns with mold material to form a mold, removing the inner and outer shroud ring patterns from the mold to leave inner and outer shroud ring mold cavities having configurations corresponding to the configurations of the shroud ring patterns, the inner and outer end Portions of the airfoils being at least partially disposed in the shroud ring mold cavities, filling the inner and outer shroud ring mold cavities with molten metal, said step of filling the inner and outer shroud ring mold cavities with molten metal including at least partially enclosing the inner end portions of the airfoils with a first annular body of molten metal having a configuration corresponding to the configuration of the inner shroud ring and at least partially enclosing the outer end portions of the airfoils with a second annular body of molten metal having a configuration corresponding to the configuration of the outer shroud ring, and solidifying the molten metal in the inner and outer shroud ring mold cavities to form the inner and outer shroud rings, said step of solidifying the molten metal including solidifying the molten metal in the inner shroud ring mold cavity around the inner end portions of the airfoils and solidifying the molten metal in the outer shroud ring mold cavity around the outer end portions of the airfoils.

11. A method as set forth in claim 10 further including solidifying a first material around the airfoils, said steps of molding one piece annular inner and outer shroud ring patterns including shaping at least a portion of the pattern material forming the inner shroud ring pattern by engagement of the pattern material with the first material and shaping at least a portion of the pattern material forming the outer shroud ring pattern by engagement of the pattern material with the first material.

12. A method as set forth in claim 11 further removing at least a portion of the first material from between the inner and outer shroud ring patterns after performing said steps of molding one piece annular inner and outer shroud ring patterns and prior to performing said step of covering the inner and outer shroud ring patterns with mold material to form a mold.

13. A method as set forth in claim 10 further including the steps of at least almost completely enclosing each of the airfoils with a first material, removing from the airfoils portions of first material to expose surface areas of the airfoils, said steps of molding one piece annular inner and outer shroud ring patterns including engaging surfaces of the airfoils exposed by removing portions of the first material with the inner and outer shroud ring patterns.

14. A method comprising the steps of providing a first plurality of airfoils, molding first bodies of a first material around the airfoils of the first plurality of airfoils with the airfoils in a first orientation relative to the first bodies, positioning the first plurality of airfoils in a first spatial relationship relative to each other by positioning the first bodies of the first material in a first predetermined relationship relative to each other, solidifying a first body of pattern material around the first plurality of airfoils while the first plurality of airfoils are in the first spatial relationship, covering the first body of pattern material with mold material to at least partially form a first mold, removing the first body of pattern material from the first mold to leave a first mold cavity into which end portions of the first plurality of airfoils extend, filling the first mold cavity with molten metal which extends around end portions of each of the airfoils of the first plurality of airfoils, solidifying the molten metal in the first mold cavity to at least partially form a first turbine engine component in which the first plurality of airfoils are disposed in the first spatial relationship relative to each other, providing a second plurality of airfoils, molding second bodies of the first material around the airfoils of the second plurality of airfoils with the second plurality of airfoils in a second orientation relative to the second bodies, said second orientation being different than said first orientation, positioning the second plurality of airfoils in a second spatial relationship relative to each other by positioning the second bodies of the first material in the first predetermined relationship relative to each other, said second spatial relationship being different than said first spatial relationship, solidifying a second body of pattern material around the second plurality of airfoils while the second plurality of airfoils are in the second spatial relationship, covering the second body of pattern material with mold material to at least partially form a second mold, removing the second body of pattern material from the second mold to leave a second mold cavity into which end portions of the second plurality of airfoils extend, filling the second mold cavity with molten metal which extends around end portions of each of the airfoils of the second plurality of airfoils, and solidifying the molten metal in the second mold cavity to at least partially form a second turbine engine component in which the second plurality of airfoils are disposed in the second spatial relationship relative to each other.

15. A method as set forth in claim 14 wherein said step of positioning the first plurality of airfoils in a first spatial relationship relative to each other includes positioning the first bodies of the first material in an annular array to position the first plurality of airfoils in a first annular array, said step of solidifying a first body of pattern material around the first plurality of airfoils includes solidifying a first annular body of the pattern material around the first plurality of airfoils while the first plurality of airfoils are disposed in the first annular array, said step of positioning the second plurality of airfoils in a second spatial relationship relative to each other includes positioning the second bodies of the first material in an annular array to position the second plurality of airfoils in a second annular array, said step of solidifying a second body of pattern material around the second plurality of airfoils includes solidifying a second annular body of the pattern material around the second plurality of airfoils while the second plurality of airfoils are disposed in the second annular array.

16. A method as set forth in claim 14 wherein said step of positioning the first bodies of the first material in a first predetermined spatial relationship relative to each other includes positioning the first bodies of the first material in engagement with each other, said step of positioning the second bodies of the first material in the first predetermined spatial relationship relative to each other includes positioning the second bodies of the first material in engagement with each other.

17. A method as set forth in claim 14 wherein said step of molding first bodies of a first material around the airfoils of the first plurality of airfoils with the airfoils in a first orientation relative to the first bodies includes positioning the first plurality of airfoils in a secondary mold cavity with the airfoils of the first plurality of airfoils in the first orientation, and solidifying the first material around airfoils of the first plurality of airfoils in the secondary mold cavity while the airfoils are in the first orientation to form the first bodies of the first material, said step of molding second bodies of the first material around the airfoils of the second plurality of airfoils with the second plurality of airfoils in a second orientation relative to the second bodies includes positioning the airfoils of the second plurality of airfoils in the secondary mold cavity which is the same secondary mold cavity in which the airfoils of the first plurality of airfoils were positioned, said step of positioning the airfoils of the second plurality of airfoils in the secondary mold cavity including positioning the airfoils in the second orientation, and solidifying the first material around the airfoils of the second plurality of airfoils in the secondary mold cavity while the airfoils are in the second orientation to form the second bodies of the first material.

18. A method as set forth in claim 14 further including the steps of removing the first bodies of the first material from around the airfoils of the first plurality of airfoils after performing said step of solidifying a first body of pattern material around the first plurality of airfoils and prior to performing said step of covering the first body of pattern material with mold material, and removing the second bodies of the first material from around the airfoils of the second plurality of airfoils after performing said step of solidifying a second body of pattern material around the second plurality of airfoils and prior to performing said step of covering the second body of pattern material with mold material.

19. A method as set forth in claim 14 wherein said step of molding first bodies of the first material around airfoils of the first plurality of airfoils includes at least almost completely enclosing each of the airfoils of the first plurality of airfoils with the first material, said method further including removing from each of the airfoils of the first plurality of airfoils portions of the first material overlying surface areas on each of the airfoils of the first plurality of airfoils, said step of solidifying a first body of pattern material around the first plurality of airfoils includes solidifying the pattern material with the pattern material in engagement with the surface areas on the first plurality of airfoils from which the first the first material was removed, said step of molding second bodies of the first material around airfoils of the second plurality of airfoils includes at least almost completely enclosing each of the airfoils of the second plurality of airfoils with the first material, said method further including removing from each of the airfoils of the second plurality of airfoil portions of the first material overlying surface areas on each of the airfoils of the second plurality of airfoils, said step of solidifying a second body of pattern material around the second plurality of airfoils includes solidifying the pattern material with the pattern material in engagement with surface areas on the second plurality of airfoils from which the first material was removed.

20. A method as set forth in claim 1 wherein said step of solidifying the first body of pattern material around the first plurality of airfoils includes at least partially shaping the first body of pattern material by engagement of the pattern material with the first bodies of the first material, said step of solidifying the second body of pattern material around the second plurality of airfoils includes at least partially shaping the second body of pattern material by engagement of the pattern material with the second bodies of the first material.

21. A method of making a turbine engine component having a plurality of airfoils disposed in an annular array, said method comprising the steps of providing a plurality of airfoils, solidifying a first material around the airfoils to at least almost completely enclose each of the airfoils with the first material, removing from the airfoils portions of the first material overlying surface areas on each of the airfoils, solidifying pattern material around the airfoils with the pattern material in engagement with the surface areas on each of the airfoils from which the first material was removed, covering the pattern material with mold material to at least partially form a mold, removing the pattern material from the mold to leave a mold cavity, an end portion of each of the airfoils being at least partially disposed in the mold cavity, filling the mold cavity with molten metal which extends around end portions of the airfoils, and solidifying the molten metal in the mold cavity.

22. A method as set forth in claim 21 wherein said step of solidifying pattern material around the airfoils includes at least partially shaping the pattern material by engagement of the pattern material with the first material.

23. A method as set forth in claim 21 wherein said step of solidifying pattern material around the airfoils includes molding a one piece annular shroud ring pattern around the end portions of the airfoils.

24. A method as set forth in claim 21 wherein said step of solidifying a first material around the airfoils includes molding a plurality of separate bodies of the first material around the airfoils, said method further including positioning the bodies of the first material in an annular array to position the airfoils in an annular array, said step of solidifying pattern material around the airfoils being performed after performance of said step of positioning the bodies of the first material in an annular array.

25. A method as set forth in claim 21 further including the step of removing the remaining portions of the first material from around the airfoils after performing said step of solidifying the pattern material around the airfoils 26. A method as set forth in claim 25 wherein said step of removing the remaining portions of the first material includes dissolving the remaining portions of the first material after solidifying the pattern material.

27. A method as set forth in claim 21 wherein said step of solidifying a first material around the airfoils includes positioning the airfoils in a secondary mold cavity and filling the secondary mold cavity with the first material.

28. A method of making a turbine engine component having a plurality of airfoils disposed in an annular array, said method comprising the steps of providing a plurality of airfoils, molding bodies of a first material around the airfoils, positioning the bodies of the first material in an annular array to position the airfoils in an annular array, thereafter, forming a circular pattern mold cavity into which end portions of the airfoils extend, conducting a flow of pattern material into the circular pattern mold cavity to fill the pattern mold cavity, solidifying a circular body of pattern material in the pattern mold cavity and around end portions of the airfoils covering the pattern material with mold material to at least partially form a mold which is connected with each of the airfoils, removing the pattern material from the mold to leave a cavity in the mold, an end portion of each of the airfoils being at least partially disposed in the cavity in the mold, filling the cavity in the mold with molten metal which extends around end portions of the airfoils, and solidifying the molten metal in the cavity in the mold.

29. A method as set forth in claim 21 wherein said step of positioning the bodies of the first material in an annular array includes positioning the bodies of the first material in abutting engagement with each other.

30. A method as set forth in claim 28 further including the step of removing at least a portion of the bodies of a first material from around the airfoils after performing said step of solidifying a circular body of pattern material in the pattern mold cavity and prior to performing said step of covering the pattern material with mold material.

31. A method as set forth in claim 30 wherein said step of removing the bodies of a first material includes dissolving the bodies of a first material.

32. A method as set forth in claim 28 wherein said step of forming a circular pattern mold cavity includes positioning a pattern mold wall in engagement with the bodies of a first material, said step of solidifying pattern material in the pattern mold cavity includes at least partially shaping the pattern material by engagement of the pattern material with the pattern mold wall and with the bodies of a first material.

33. A method as set forth in claim 28 wherein said step of molding bodies of a first material around the airfoils includes positioning at least a portion of each of the airfoils in turn in a secondary mold cavity and filling the secondary mold cavity with the first material to form a separate body of the first material around each of the airfoils.

34. A method comprising the steps of providing a first plurality of airfoils having leading and trailing edge portions extending between inner and outer end portions of the airfoils, molding first bodies of a first material around central portions of the airfoils of the first plurality of airfoils with the airfoils in a first orientation relative to the first bodies, positioning the first plurality of airfoils in a first annular array with the first plurality of airfoils in a first spatial relationship relative to each other by positioning the first bodies of the first material in an annular array, molding a one piece annular inner shroud ring pattern around the inner end portions of the first plurality of airfoils while the first plurality of airfoils are in the first spatial relationship, molding a one piece annular outer shroud ring pattern around the outer end portions of the first plurality of airfoils while the first plurality of airfoils are in the first spatial relationship, covering the inner and outer shroud ring patterns with mold material to at least partially form a first mold, removing the inner and outer shroud ring patterns from the first mold to leave inner and outer shroud ring mold cavities into which end portions of the first plurality of airfoils extend, filling the inner and outer shroud ring mold cavities with molten metal which extends around the inner and outer end portions of each of the airfoils of the first plurality of airfoils, and solidifying the molten metal in the inner and outer shroud ring mold cavities to at least partially form a first turbine engine component in which the first plurality of airfoils are disposed in the first spatial relationship relative to each other, providing a second plurality of airfoils having leading and trailing edge portions extending between inner and outer end portions of the airfoils, molding second bodies of the first material around central portions of the airfoils of the second plurality of airfoils with the airfoils in a second orientation relative to the second bodies, said second orientation being different than said first orientation, positioning the second plurality of airfoils in a second annular array with the second plurality of airfoils in a second spatial relationship relative to each other by positioning the second bodies of the first material in an annular array, said second spatial relationship being different than said first spatial relationship, molding a one piece annular inner shroud ring pattern around the inner end portions of the second plurality of airfoils while the second plurality of airfoils are in the second spatial relationship, molding a one piece annular outer shroud ring pattern around the outer end portions of the second plurality of airfoils while the second plurality of airfoils are in the second spatial relationship, covering the inner and outer shroud ring patterns which are molded around the second plurality of airfoils with mold material to at least partially form a second mold, removing the inner and outer shroud ring patterns from the second mold to leave inner and outer shroud ring mold cavities into which end portions of the second plurality of airfoils extend, filling the inner and outer shroud ring mold cavities in the second mold with molten metal which extends around the inner and outer end portions of each of the airfoils of the second plurality of airfoils, and solidifying the molten metal in the inner and outer shroud ring mold cavities in the second mold to at least partially form a second turbine engine component in which the second plurality of airfoils are disposed in the second spatial relationship relative to each other

35. A method as set forth in claim 34 wherein said step of molding first bodies of the first material around central portions of the airfoils of the first plurality of airfoils includes at least almost completely enclosing each of the airfoils of the first plurality of airfoils with the first material, said method further including removing from each of the airfoils of the first plurality of airfoils portions of the first material overlying surface areas on each of the airfoils of the first plurality of airfoils, said steps of molding inner and outer shroud ring patterns around the end portions of the first plurality of airfoils includes solidifying the pattern material with the pattern material in engagement with the surface areas on the first plurality of airfoils from which the first material was removed, said step of molding second bodies of the first material around central portions of the airfoils of the second plurality of airfoils includes at least almost completely enclosing each of the airfoils of the second plurality of airfoils with the first material, said method further including removing from each of the airfoils of the second plurality of airfoils Portions of the first material overlying surface areas on each of the airfoils of the second plurality of airfoils, said steps of molding inner and outer shroud ring patterns around the end portions of the second plurality of airfoils includes solidifying the pattern material with the pattern material in engagement with surface areas on the second plurality of airfoils from which the first material was removed.

36. A method as set forth in claim 34 wherein said molding of inner and outer shroud ring patterns around the end portions of the first plurality of airfoils includes at least partially shaping the inner and outer shroud ring pattern material by engagement of the pattern material with the first bodies of the first material, said steps of folding inner and outer shroud ring patterns around the end portions of the second plurality of airfoils includes at least partially shaping the inner and outer shroud ring pattern material by engagement of the pattern material with the second bodies of the first material.

37. A method of making a first turbine engine component having airfoils disposed in a first orientation relative to a first shroud ring and of making a second turbine engine component having airfoils disposed in a second orientation relative to a second shroud ring, the first orientation of the airfoils of the first turbine engine component being different than the second orientation of the airfoils of the second turbine engine component, said method comprising the steps of positioning a first series of airfoils in an array with end portions of the first series of airfoils extending into a shroud ring pattern mold cavity and with the first series of airfoils disposed in the first orientation relative to the shroud ring pattern mold cavity, said step of positioning the first series of airfoils in an array with end portions of the first series of airfoils extending into a shroud ring pattern mold cavity including positioning the end portions of the airfoils in a shroud ring pattern mold cavity which is at least partially formed by first shroud ring pattern dies, filling the shroud ring pattern mold cavity with pattern material while the first series of airfoils are disposed in the first orientation relative to the shroud ring pattern mold cavity to form a first pattern having a configuration corresponding to the configuration of at least a portion of the first shroud ring, covering the first pattern with mold material to at least partially form a first mold, removing the first pattern from the first mold to leave a first mold cavity into which end portions of the first series of airfoils extend with the first series of airfoils disposed in the first orientation relative to the first mold cavity, filling the first mold cavity with molten metal, solidifying the molten metal in the first mold cavity to form at least a portion of the first shroud ring with the first series of airfoils disposed in the first orientation, positioning a second series of airfoils in an array with end portions of the second series of airfoils extending into a shroud ring pattern mold cavity which is at least partially formed by the first shroud ring pattern dies, said step of positioning the second series of airfoils in an array with end portions extending into the shroud ring pattern mold cavity including positioning the second series of airfoils in the second orientation relative to the shroud ring pattern mold cavity, filling the shroud ring pattern mold cavity with pattern material while the second series of airfoils are disposed in the second orientation relative to the shroud ring pattern mold cavity to form a second pattern having the same configuration as the first pattern and corresponding to the configuration of at least a portion of the second shroud ring, covering the second pattern with mold material to at least partially form a second mold, removing the second pattern from the second mold to leave a second mold cavity into which end portions of the second series of airfoils extend with the second series of airfoils disposed in the second orientation relative to the second mold cavity, filling the second mold cavity with molten metal solidifying the molten metal in the second mold cavity to form at least a portion of the second shroud ring with the second series of airfoils disposed in the second orientation.

38. A method as set forth in claim 37 wherein said step of positioning a first series of airfoils in an array with end portions of the first series of airfoils extending into a shroud ring pattern mold cavity includes positioning the first series of airfoils in an annular array with end portions of the first series of airfoils extending into an annular shroud ring pattern mold cavity, said step of positioning a second series of airfoils in an array with end portions of the second series of airfoils extending into the shroud ring pattern mold cavity includes positioning the second series of airfoils in an annular array with end portions of the second series of airfoils extending into the annular shroud ring mold cavity.

39. A method of making a first turbine engine component having airfoils disposed in one orientation relative to a first shroud ring and of making a second turbine engine component having airfoils disposed in another orientation relative to a second shroud ring, the orientation of the airfoils of the first turbine engine component being different than the orientation of the airfoils of the second turbine engine component, said method comprising the steps of providing a first plurality of airfoils, positioning airfoils of the first plurality of airfoils in a secondary mold cavity with the airfoils of the first plurality of airfoils in a first orientation, solidifying a first material around airfoils of the first plurality of airfoils in the secondary mold cavity while the airfoils are in the first orientation to form first positioning bodies of the first material around the airfoils of the first plurality of airfoils, positioning airfoils of the first plurality of airfoils relative to each other by locating first positioning bodies relative to each other, thereafter, solidifying pattern material around end portions of airfoils of the first plurality of airfoils, covering the pattern material with mold material to at least partially form a first mold, removing the pattern material from the first mold to leave a first mold cavity, filling the first mold cavity with molten metal, solidifying the molten metal in the first mold cavity to at least partially form the first turbine engine component with the airfoils disposed in the one orientation, providing a second plurality of airfoils, positioning airfoils of the second plurality of airfoils in the secondary mold cavity which is the same secondary mold cavity in which the airfoils of the first plurality of airfoils were positioned, said step of positioning the airfoils of the second plurality of airfoils in the secondary fold cavity including positioning the airfoils in a second orientation which is different than the first orientation, solidifying the first material around the airfoils of the second plurality of airfoils in the secondary mold cavity while the airfoils are in the second orientation to form second positioning bodies of the first material around the airfoils of the second plurality of airfoils, positioning airfoils of the second plurality of airfoils relative to each other by locating second positioning bodies relative to each other, thereafter, solidifying pattern material around end portions of airfoils of the second plurality of airfoils, covering the pattern material around end portions of airfoils of the second plurality of airfoils with mold material to at least partially form a second mold, removing pattern material from the second mold to leave a second mold cavity, filling the second mold cavity with molten metal, and solidifying the molten metal in the second mold cavity to at least partially form the second turbine engine component with the airfoils in the other orientation.

40. A method as set forth in claim 39 wherein said step of solidifying pattern material around end portions of airfoils of the first plurality of airfoils includes at least partially shaping the pattern material by engagement of the pattern material with first positioning bodies, said step of solidifying pattern material around end portions of airfoils of the second plurality of airfoils includes at least partially shaping the pattern material by engagement of the pattern material with second positioning bodies.

41. A method as set forth in claim 39 wherein said step of solidifying a first material around airfoils of the first plurality of airfoils to form first positioning bodies includes molding a separate body of the first material around each of the airfoils of the first plurality of airfoils, said step of sequentially solidifying a first material around airfoils of the second plurality of airfoils to form second positioning bodies includes molding a separate body of the first material around each of the airfoils of the second plurality of airfoils.

42. A method as set forth in claim 39 wherein said step of positioning airfoils of the first plurality of airfoils relative to each other includes positioning the first bodies of positioning material in an annular array to position the airfoils of the first plurality of airfoils in an annular array, said step of positioning airfoils of the second plurality of airfoils relative to each other includes positioning the second bodies of positioning material in an annular array to position the second plurality of airfoils in an annular array.

43. A method as set forth in claim 39 wherein said step of solidifying pattern material around end portions of the first plurality of airfoils includes solidifying an annular body of pattern material around end portions of the first plurality of airfoils, said step of solidifying pattern material around end portions of the second plurality of airfoils includes solidifying an annular body of pattern material around end portions of the second plurality of airfoils.

44. A method as set forth in claim 39 further including the steps of removing the material of the first positioning bodies from around the airfoils of the first plurality of airfoils after performing said step of solidifying pattern material around end portions of airfoils of the first plurality of airfoils and removing the material of the second positioning bodies from around the airfoils of the second plurality of airfoils after performing said step of solidifying pattern material around end portions of airfoils of the second plurality of airfoils.

45. A method as set forth in claim 44 wherein said step of removing the material of the first positioning bodies from around the airfoils of the first plurality of airfoils includes dissolving the material of the first positioning bodies, said step of removing the material of the second positioning bodies from around the airfoils of the second plurality of airfoils includes dissolving the material of the second positioning bodies.

46. A method as set forth in claim 39 wherein said step of positioning airfoils of the first plurality of airfoils relative to each other includes positioning the airfoils of the first plurality of airfoils in a first annular array, said step of solidifying pattern material around end portions of airfoils of the first plurality of airfoils includes solidifying a first annular body of pattern material which engages each of the airfoils in the first annular array of airfoils to form a first one piece body of pattern material connected with each of the airfoils in the first annular array of airfoils, said step of positioning airfoils of the second plurality of airfoils relative to each other includes positioning the airfoils of the second plurality of airfoils in a second annular array, said step of solidifying pattern material around end portions of airfoils of the second plurality of airfoils includes solidifying a second annular body of pattern material which engages each of the airfoils in the second annular array of airfoils to form a second one piece body of pattern material connected with each of the airfoils in the second annular array of airfoils.

47. A method as set forth in claim 39 wherein said step of solidifying a first material around airfoils of the first plurality of airfoils in the secondary mold cavity includes at least almost completely enclosing each of the airfoils of the first plurality of airfoils with the first material, said method further including removing from the airfoils of the first plurality of airfoils portions of the first material overlying surface areas on each of the airfoils of the first plurality of airfoils, said step of solidifying pattern material around end portions of airfoils of the first plurality of airfoils including solidifying the pattern material with the pattern material in engagement with surface areas from which the first material was removed, said step of solidifying a first material around airfoils of the second plurality of airfoils in the secondary mold cavity includes at least almost completely enclosing each of the airfoils of the second plurality of airfoils with the first material, said method further including removing from the airfoils of the second plurality of airfoils portions of the first material overlying surface areas on each of the airfoils of the second plurality of airfoils, said step of solidifying pattern material around end portions of airfoils of the second plurality of airfoils including solidifying the pattern material with the pattern material in engagement with surface areas from which the first material was removed.

48. A method of making a first turbine engine component having airfoils disposed in one orientation relative to a first shroud ring and of making a second turbine engine component having airfoils disposed in another orientation relative to a second shroud ring, the orientation of the airfoils of the first turbine engine component being different that the orientation of the airfoils of the second turbine engine component, said method comprising the steps of providing a first plurality of airfoils, molding first bodies of a positioning material around airfoils of the first plurality of airfoils with the airfoils in a first orientation relative to the first bodies of positioning material, positioning airfoils of the first plurality of airfoils in an annular array by locating the first bodies of positioning material in an annular array, thereafter, solidifying pattern material around end portions of airfoils of the first plurality of airfoils while the first plurality of airfoils are disposed in an annular array, covering the pattern material with mold material to at least partially form a first mold, removing the pattern material from the first mold to leave a first mold cavity, filling the first mold cavity with molten metal, solidifying the molten metal in the first mold cavity to at least partially form the first turbine engine component with the airfoils disposed in the one orientation, providing a second plurality of airfoils, molding second bodies of positioning material around airfoils of the second plurality of airfoils with the airfoils in a second orientation relative to the second bodies of positioning material, the first orientation of the first plurality of airfoils relative to the first bodies of positioning material being different than the second orientation of the second plurality of airfoils relative to the second bodies of positioning material, positioning airfoils of the second plurality of airfoils in an annular array by locating the second bodies of positioning material in an annular array, thereafter, solidifying pattern material around end portions of airfoils of the second plurality of airfoils while the second plurality of airfoils are disposed in an annular array, covering the pattern material around end portions of airfoils of the second plurality of airfoils with mold material to at least partially form a second mold, removing pattern material from the second mold to leave a second mold cavity, filling the second mold cavity with molten metal, and solidifying the molten metal in the second mold cavity to at least partially form the second turbine engine component with the airfoils in the other orientation.

49. A method as set forth in claim 48 wherein said step of solidifying pattern material around end portions of airfoils of the first plurality of airfoils includes at least partially shaping the pattern material by engagement of the pattern material with the first bodies of positioning material, said step of solidifying pattern material around end portions of airfoils of the second plurality of airfoils includes at least partially shaping the pattern material by engagement of the pattern material with the second bodies of positioning material.

50. A method as set forth in claim 49 wherein said step of molding first bodies of positioning material around airfoils of the first plurality of airfoils includes molding a separate body of the positioning material around each of the airfoils of the first plurality of airfoils, said step of molding second bodies of positioning material around airfoils of the second plurality of airfoils includes molding a separate body of the positioning material around each of the airfoils of the second plurality of airfoils.

51. A method as set forth in claim 48 wherein said step of solidifying pattern material around end portions of the first plurality of airfoils includes solidifying an annular body of pattern material around end portions of the first plurality of airfoils, said step of solidifying pattern material around end portions of the second plurality of airfoils includes solidifying an annular body of pattern material around end portions of the second plurality of airfoils.

52. A method as set forth in claim 48 further including the steps of removing the material of the first bodies of positioning material from around the airfoils of the first plurality of airfoils after performing said step of solidifying pattern material around end portions of airfoils of the first plurality of airfoils and removing the material of the second bodies of positioning material from around the airfoils of the second plurality of airfoils after performing said step of solidifying pattern material around end portions of airfoils of the second plurality of airfoils.

53. A method as set forth in claim 52 wherein said step of removing the material of the first bodies of positioning material from around the airfoils of the first plurality of airfoils includes dissolving the material of the first bodies of positioning material, said step of removing the material of the second bodies of positioning material from around the airfoils of the second plurality of airfoils includes dissolving the material of the second bodies of positioning material.

54. A method of making at least a portion of a turbine engine component having a plurality of airfoils connected with a shroud ring, said method comprising the steps of providing a plurality of airfoils having leading and trailing edge portions extending between opposite end portions of the airfoils, positioning the plurality of airfoils in an array, thereafter, molding as one piece at least a portion of a shroud ring pattern which engages end portions of the plurality of airfoils while the plurality of airfoils are disposed in the array, said step of molding as one piece at least a portion of a shroud ring pattern includes forming a shroud ring pattern mold cavity into which end portions of the plurality of airfoils extend, filling the shroud ring pattern mold cavity with liquid pattern material, said step of filling the shroud ring pattern mold cavity with liquid pattern material including engaging end portions of the plurality of airfoils with a body of liquid pattern material while the plurality of airfoils are disposed in the array, solidifying the liquid pattern material in the shroud ring pattern mold cavity around end portions of the plurality of airfoils to form at least a portion of a shroud ring pattern, covering the shroud ring pattern with mold material to at least partially form a mold, removing the shroud ring pattern from the mold to leave a shroud ring mold cavity having a configuration corresponding to the configuration of at least a portion of the shroud ring, end portions of the plurality of airfoils being at least partially disposed in the shroud ring mold cavity, filling the shroud ring mold cavity with molten metal, said step of filling the shroud ring mold cavity with molten metal including engaging the end portions of the plurality of airfoils with a body of molten metal having a configuration corresponding to the configuration of at least a portion of a shroud ring, and solidifying the molten metal in the shroud ring mold cavity to at least partially form the shroud ring, said step of solidifying the molten metal including solidifying the molten metal in the shroud ring mold cavity in engagement with the end portions of the plurality of airfoils.

55. A method as set forth in claim 54 further including solidifying a first material around the airfoils, said step of molding at least a portion of a shroud ring pattern including shaping at least a portion of the pattern material by engagement of the pattern material with the first material and with the end portions of the plurality of airfoils.

56. A method as set forth in claim 55 further including removing at least a portion of the first material from between the airfoils after performing said step of molding at least a portion of a shroud ring pattern and prior to performing said step of covering the shroud ring pattern with mold material to form a mold.

57. A method as set forth in claim 54 further including the steps of at least partially enclosing each of the airfoils with a first material, removing from the airfoils portions of first material to expose surface areas of the airfoils, said step of molding at least a portion of a shroud ring pattern including engaging surface areas of the airfoils exposed by removing portions of the first material with the liquid pattern material.

58. A method as set forth in claim 54 wherein said step of positioning the plurality of airfoils in an array includes positioning the plurality of airfoils in an annular array, said step of molding a shroud ring pattern around end portions of the plurality of airfoils includes molding a one piece annular shroud ring pattern around end portions of the plurality of airfoils while the plurality of airfoils are in the annular array, said step of forming a shroud ring pattern mold cavity includes forming an annular shroud ring pattern mold cavity.

59. A method comprising the steps of providing a first plurality of airfoils, positioning the airfoils of the first plurality of airfoils in a secondary mold cavity with the airfoils of the first plurality of airfoils in a first orientation, solidifying first bodies of a first material around the airfoils of the first plurality of airfoils with the airfoils in the first orientation in the secondary mold cavity, positioning the first plurality of airfoils in a first spatial relationship relative to each other by locating the first bodies of the first material relative to each other, forming a first mold cavity into which end portions of the first plurality of airfoils extend, said step of forming a first mold cavity being performed with the first plurality of airfoils in the first spatial relationship relative to each other, filling the first mold cavity with molten metal which extends around end portions of each of the airfoils of the first plurality of airfoils, solidifying the molten metal in the first mold cavity to at least partially form a first turbine engine component in which the first plurality of airfoils are disposed in the first spatial relationship relative to each other, providing a second plurality of airfoils, positioning the airfoils of the second plurality of airfoils in the secondary mold cavity with the airfoils of the second plurality of airfoils in a second orientation, said step of positioning the airfoils of the second plurality of airfoils in the secondary mold cavity including positioning the second plurality of airfoils in the same secondary mold cavity in which the first plurality of airfoils were positioned, solidifying second bodies of the first material around the airfoils of the second plurality of airfoils with the second plurality of airfoils in the second orientation in the secondary mold cavity, said second orientation being different than said first orientation, positioning the second plurality of airfoils in a second spatial relationship relative to each other by locating the second bodies of the first material relative to each other, said second spatial relationship being different than said first spatial relationship, forming a second mold cavity into which end portions of the second plurality of airfoils extend, said step of forming a second mold cavity being performed with the second plurality of airfoils in the second spatial relationship relative to each other, filling the second mold cavity with molten metal which extends around end portions of each of the airfoils of the second plurality of airfoils, and solidifying the molten metal in the second mold cavity to at least partially form a second turbine engine component in which the second plurality of airfoils are disposed in the second spatial relationship relative to each other.

60. A method as set forth in claim 59 wherein said step of forming a first mold cavity includes engaging end portions of the first plurality of airfoils with liquid pattern material while the first plurality of airfoils are in the first spatial relationship and solidifying the liquid pattern material to form a first body of pattern material around the end portions of the first plurality of airfoils while the first plurality of airfoils are in the first spatial relationship, covering the first body of pattern material with mold material to at least partially form a first mold, and removing the first body of pattern material from the first mold to leave the first mold cavity, said step of forming a second mold cavity includes engaging end portions of the second plurality of airfoils with liquid pattern material while the second plurality of airfoils are in the second spatial relationship and solidifying the liquid pattern material to form a second body of pattern material around the end portions of the second plurality of airfoils while the second plurality of airfoils are in the second spatial relationship, covering the second body of pattern material with mold material to at least partially form a second mold, and removing the second body of pattern material from the second mold to leave the second mold cavity.

61. A method as set forth in claim 59 wherein said step of positioning the first plurality of airfoils in a first spatial relationship relative to each other includes positioning the first bodies of the first material in an annular array to position the first plurality of airfoils in a first annular array, said step of positioning the second plurality of airfoils in a second spatial relationship relative to each other includes positioning the second bodies of the first material in an annular array to position the second plurality of airfoils in a second annular array.

62. A method as set forth in claim 59 wherein said step of positioning the first plurality of airfoils in a first spatial relationship relative to each other includes positioning the first bodies of the first material in engagement with each other, said step of positioning the second plurality of airfoils in a second spatial relationship relative to each other includes positioning the second bodies of the first material in engagement with each other.

63. A method as set forth in claim 59 wherein said step of forming a first mold cavity includes solidifying a first body of pattern material around end portions of the first plurality of airfoils, removing the first bodies of the first material from around the airfoils of the first plurality of airfoils, covering the first body of pattern material with mold material after performing said step of removing the first bodies of the first material to at least partially form a first mold, and removing the first body of pattern material from the first mold to leave the first mold cavity, said step of forming a second mold cavity includes solidifying a second body of pattern material around end portions of the second plurality of airfoils, removing the second bodies of the first material from around the airfoils of the second plurality of airfoils, covering the second body of pattern material with mold material after performing said step of removing the second bodies of the first material to at least partially form a second mold, and removing the second body of pattern material from the second mold to leave the second mold cavity.

64. A method comprising the steps of providing a first plurality of airfoils, forming first bodies of a first material around the airfoils of the first plurality of airfoils, positioning the first plurality of airfoils in a first spatial relationship relative to each other, forming a first body of pattern material around the airfoils of the first plurality of airfoils while the first plurality of airfoils are in the first spatial relationship relative to each other, removing the first bodies of the first material from around the airfoils of the first plurality of airfoils while the first plurality of airfoils are in the first spatial relationship relative to each other, covering the first body of pattern material with mold material after performing said step of removing the first bodies of the first material from around the airfoils of the first plurality of airfoils and while the first plurality of airfoils are in the first spatial relationship relative to each other to at least partially form a first mold, removing the first body of pattern material from the first mold to leave a first mold cavity into which the first plurality of airfoils extend, filling the first mold cavity with molten metal which extends around each of the airfoils of the first plurality of airfoils while the first plurality of airfoils are in the first spatial relationship relative to each other, solidifying the molten metal in the first mold cavity to at least partially form a turbine engine component in which the first plurality of airfoils are disposed in the first spatial relationship relative to each other, providing a second plurality of airfoils, forming second bodies of the first material around the airfoils of the second plurality of airfoils, positioning the second plurality of airfoils in a second spatial relationship relative to each other, said second spatial relationship being different than said first spatial relationship, forming a second body of pattern material around the airfoils of the second plurality of airfoils while the second plurality of airfoils are in the second spatial relationship relative to each other, removing the second bodies of the first material from around the airfoils of the second plurality of airfoils while the second plurality of airfoils are in the second spatial relationship relative to each other, covering the second body of pattern material with mold material after performing said step of removing the second bodies of the first material from around the airfoils of the second plurality of airfoils and while the second plurality of airfoils are in the second spatial relationship relative to each other to at least partially form a second mold, removing the second body of pattern material from the second mold to leave a second mold cavity into which the second plurality of airfoils extend, filling the second mold cavity with molten metal which extends around each of the airfoils of the second plurality of airfoils while the second plurality of airfoils ar in the second spatial relationship relative to each other, solidifying the molten metal in the second mold cavity to at least partially form a second turbine engine component in which the second plurality of airfoils are disposed in the second spatial relationship relative to each other.

65. A method as set forth in claim 64 wherein said step of forming bodies of a first material around the airfoils of the first plurality of airfoils includes positioning the airfoils of the first plurality of airfoils in a secondary mold cavity with the airfoils of the first plurality of airfoils in a first orientation and solidifying first bodies of the first material around the airfoils of the first plurality of airfoils with the airfoils in the first orientation in the secondary mold cavity, said step of forming bodies of the first material around the airfoils of the second plurality of airfoils including positioning the airfoils of the second plurality of airfoils in the secondary mold cavity with the airfoils of the second plurality of airfoils in a second orientation which is different than the first orientation, said step of positioning the airfoils of the second plurality of airfoils in the secondary mold cavity including positioning the second plurality of airfoils in the same secondary mold cavity in which the first plurality of airfoils were positioned, said step of forming bodies of the first material around the airfoils of the second plurality of airfoils further including solidifying second bodies of the first material around the second plurality of airfoils with the second plurality of airfoils in the second orientation in the secondary mold cavity.

66. A method as set forth in claim 64 wherein said step of positioning the first plurality of airfoils in a first spatial relationship relative to each other includes positioning the first bodies of the first material in a first annular array, said step of forming a first body of pattern material around the airfoils of the first plurality of airfoils includes molding a one piece annular body of pattern material around end portions of the airfoils of the first plurality of airfoils, said step of positioning the second plurality of airfoils in a second spatial relationship relative to each other includes positioning the second bodies of the first material in a second annular array, said step of forming a second body of pattern material around the airfoils of the second plurality of airfoils includes molding a one piece annular body of pattern material around end portions of the airfoils of the second plurality of airfoils.

67. A method as set forth in claim 64 wherein said step of positioning the first plurality of airfoils in a first spatial relationship relative to each other includes positioning the first bodies of the first material relative to each other, said step of positioning the second plurality of airfoils in a second spatial relationship relative to each other includes positioning the second bodies of the first material relative to each other.

68. A method as set forth in claim 64 wherein said step of forming a first body of pattern material around the airfoils of the first plurality of airfoils while the first plurality of airfoils are in the first spatial relationship relative to each other includes at least partially shaping the first body of the pattern material by engagement of the pattern material with the first bodies of the first material and with the airfoils of the first plurality of airfoils, said step of forming a second body of pattern material around the airfoils of the second plurality of airfoils while the second plurality of airfoils are in the second spatial relationship relative to each other includes at least partially shaping the second body of pattern material by engagement of the pattern material with the second bodies of the first material and with the airfoils of the second plurality of airfoils.

69. A method as set forth in claim 64 wherein said step of forming a first body of pattern material around the airfoils of the first plurality of airfoils includes forming a first pattern mold cavity into which end portions of the first plurality of airfoils extend with the first plurality of airfoils in the first spatial relationship relative to each other, filling first pattern mold cavity with liquid pattern material, said step of filling the first pattern mold cavity with liquid pattern material including engaging end portions of the first plurality of airfoils with the liquid pattern material while the first plurality of airfoils are disposed in the first spatial relationship relative to each other, said step of forming a second body of pattern material around airfoils of the second plurality of airfoils including forming a second pattern mold cavity into which end portions of the second plurality of airfoils extend with the second plurality of airfoils in the second spatial relationship relative to each other, filling the second pattern mold cavity with liquid pattern material, said step of filling the second pattern mold cavity with liquid pattern material including engaging end portions of the second plurality of airfoils with the liquid pattern material while the second plurality of airfoils are disposed in the second spatial relationship relative to each other.

70. A method as set forth in claim 64 further including removing from the airfoils of the first plurality of airfoils portions of the first material which form the first bodies of the first material to expose surface areas of the first plurality of airfoils prior to performance of said step of forming a first body of pattern material, said step of forming a first body of pattern material includes engaging surface areas on the first plurality of airfoils exposed by removing portions of the first material with the first body of pattern material, and removing from the airfoils of the second plurality of airfoils portions of the first material which form the second bodies of the first material to expose surface areas of the second plurality of airfoils prior to performance of said step of forming a second body of pattern material, said step of forming a second body of pattern material includes engaging surface areas on the second plurality of airfoils exposed by removing portions of the first material with the second body of pattern material.

71. A method of making a turbine engine component having a plurality of airfoils connected with an annular shroud ring, said method comprising the steps of providing a plurality of airfoils having leading and trailing edge portions extending between opposite end portions of the airfoils, positioning the plurality of airfoils in an annular array with end portions of the airfoils exposed, thereafter, molding a one piece annular shroud ring pattern around end portions of the plurality of airfoils while the plurality of airfoils are disposed in the annular array, said step of molding a on piece annular shroud ring pattern includes forming an annular shroud ring pattern mold cavity into which exposed end portions of the plurality of airfoils extend, filling the annular shroud ring pattern mold cavity with liquid pattern material, said step of filling the annular shroud ring pattern mold cavity with liquid patter material including engaging surfaces o the exposed end portions of the plurality of airfoils with the liquid pattern material while the plurality of airfoils are disposed in the annular array, solidifying the liquid pattern material in the annular shroud ring pattern mold cavity against surfaces on the end portions of the plurality of airfoils to at least partially enclose the end portions of the airfoils with a one piece annular shroud ring pattern which engages surfaces on the end portions of the airfoils, covering the one piece annular shroud ring pattern with mold material to at least partially form a mold, removing the one piece annular shroud ring pattern from the mold to leave an annular shroud ring mold cavity having a configuration corresponding to the configuration of the one piece annular shroud ring pattern, end portions of the plurality of airfoils being at least partially disposed in the annular shroud ring mold cavity, filling the annular shroud ring mold cavity with molten metal, said step of filling the annular shroud ring mold cavity with molten metal including at least partially enclosing the end portions of the plurality of airfoils with a body of molten metal having a configuration corresponding to the configuration of the one piece annular shroud ring pattern, and solidifying the molten metal in the annular shroud ring mold cavity to form the shroud ring, said step of solidifying the molten metal including solidifying the molten metal in the shroud ring mold cavity around the end portions of the plurality of airfoils.

72. A method as set forth in claim 71 further including solidifying a first material around the airfoils, said step of molding a one piece annular shroud ring pattern including shaping at least a portion of the liquid pattern material forming the shroud ring pattern by engagement of the pattern material with the first material at locations adjacent to where the liquid pattern material engages surfaces on the end portions of the airfoils.

73. A method as set forth in claim 72 further including removing at least a portion of the first material from between the airfoils after performing said step of molding a one piece annular shroud ring pattern and prior to performing said step of covering the one piece annular shroud ring pattern with mold material to form a mold.

74. A method as set forth in claim 71 further including the steps of at least partially enclosing each of the airfoils with a first material, removing from the airfoils portions of first material to expose surface areas of the airfoils, said step of molding a one piece annular shroud ring pattern including engaging surface areas of the airfoils exposed by removing portions of the first material with the liquid pattern material.

* * * * *

UNITED STATES PATENT AND TRADEMARK OFFICE

CERTIFICATE OF CORRECTION

PATENT NO. : 4,987,944

DATED : January 29, 1991

INVENTOR(S) : Paul L. Parks

It is certified that error appears in the above-identified patent and that said Letters Patent is hereby corrected as shown below:

Column 14, Line 19, Claim 10, change "Portions" to --portions--.

Column 14, Line 49, Claim 12, insert --including-- after "further".

Column 17, Line 3, Claim 20, change "1" to --14--.

Column 18, Line 17, Claim 29, change "21" to --28--.

Column 19, Line 64, Claim 35, change "Portions" to --portions--.

Column 20, Line 11, Claim 36, change "folding" to --molding--.

Column 21, Line 3, Claim 37, insert --,-- after "metal".

Column 21, Line 54, Claim 39, change "fold" to --mold--.

Column 30, Line 34, Claim 71, change "patter" to --pattern--.

Signed and Sealed this

Thirtieth Day of June, 1992

*Attest:*

DOUGLAS B. COMER

*Attesting Officer*

*Acting Commissioner of Patents and Trademarks*